US010524520B2

(12) United States Patent
Funabashi

(10) Patent No.: US 10,524,520 B2
(45) Date of Patent: Jan. 7, 2020

(54) SUIT PATTERN AND MEASURING DEVICE FOR SUIT PATTERN

(71) Applicant: YPSILON JAPAN CO., LTD., Tokyo (JP)

(72) Inventor: Yukihiko Funabashi, Nagasaki (JP)

(73) Assignee: YPSILON JAPAN CO., LTD., Tokyo (JP)

( * ) Notice: Subject to any disclaimer, the term of this patent is extended or adjusted under 35 U.S.C. 154(b) by 135 days.

(21) Appl. No.: 15/580,958

(22) PCT Filed: Jun. 12, 2015

(86) PCT No.: PCT/JP2015/067092
§ 371 (c)(1),
(2) Date: Dec. 8, 2017

(87) PCT Pub. No.: WO2016/199308
PCT Pub. Date: Dec. 15, 2016

(65) Prior Publication Data
US 2018/0177246 A1 Jun. 28, 2018

(51) Int. Cl.
*A41H 3/00* (2006.01)
*A41D 1/02* (2006.01)
(Continued)

(52) U.S. Cl.
CPC ..... *A41D 1/02* (2013.01); *A41H 1/02* (2013.01); *A41H 3/06* (2013.01)

(58) Field of Classification Search
CPC ..... A41D 1/02; A41H 1/02; A41H 3/06
(Continued)

(56) References Cited

U.S. PATENT DOCUMENTS 3,745,656 A * 7/1973 Sweeney ..... A41H 3/015 33/14
3,815,154 A * 6/1974 Gearhart ..... A41D 1/02 2/93
(Continued)

FOREIGN PATENT DOCUMENTS

JP 53-87839 A 8/1978
JP 59-157303 A 9/1984
(Continued)

OTHER PUBLICATIONS

International Search Report dated Sep. 29, 2015 for PCT/JP2015/067092 and English translation.

*Primary Examiner* — George B Bennett
(74) *Attorney, Agent, or Firm* — Lucas & Mercanti, LLP

(57) ABSTRACT

A suit pattern contains: setting, as left and right shoulder rear virtual base points, points specified by moving forward from the center line of the back region by a length that is one-half the circumference of the chest multiplied by 0.177±0.005, and then moving upward perpendicularly from that point approximately one-fourth of the length of the movement length; setting as left and right shoulder front-rear virtual base points, points specified according to the intersection of a line perpendicular to a position that is 0.56±0.05 times the length from the front body front-end edge to the front-end edge of the sleeve hole, and absolute horizontal line from the left or right shoulder front-rear base point; setting as left and right front-rear virtual base points and the cut-off front-rear end section of the sleeve hole at a fixed adjustment angle; and stitching each of the front-rear shoulder ridge lines together.

4 Claims, 18 Drawing Sheets

(51) Int. Cl.
*A41H 1/02* (2006.01)
*A41H 3/06* (2006.01)

(58) Field of Classification Search
USPC ..... 33/11–16, 512
See application file for complete search history.

(56) References Cited

U.S. PATENT DOCUMENTS 3,979,831 A * 9/1976 Lutz ..... A41H 3/00 33/17 R
4,224,740 A * 9/1980 Gibson ..... A41H 3/00 33/12
4,265,020 A * 5/1981 Werber ..... A41H 3/015 33/14
4,796,305 A * 1/1989 Itoh ..... A41D 1/02 2/255
4,860,900 A * 8/1989 Forschner ..... A41H 3/08 206/574
4,885,844 A * 12/1989 Chun ..... A41H 1/02 33/15
4,995,514 A * 2/1991 Forschner ..... A41H 3/08 206/574
5,060,393 A * 10/1991 Silverman ..... A61B 5/107 33/512
6,073,359 A * 6/2000 Lee ..... A61B 5/1072 33/483
6,226,881 B1 * 5/2001 Landauer ..... G01B 5/061 33/511
8,549,763 B2 * 10/2013 Krawchuk ..... A41B 9/00 2/243.1
2005/0150124 A1 * 7/2005 Greenawalt ..... A61B 5/1072 33/512
2005/0278824 A1 * 12/2005 Gadot ..... A41D 1/02 2/108
2006/0265892 A1 * 11/2006 Sieber ..... A41H 1/02 33/512
2009/0223427 A1 * 9/2009 Turney ..... A41B 13/00 112/475.09
2012/0096726 A1 * 4/2012 Glock, Jr. ..... A61B 5/1072 33/512
2014/0137309 A1 * 5/2014 Bailey-Woods ..... A41D 27/06 2/93
2014/0202017 A1 * 7/2014 Wood ..... G01B 3/20 33/512
2014/0298667 A1 * 10/2014 Alkhalaf ..... A61B 5/1077 33/514.2
2015/0081468 A1 * 3/2015 Fenimore ..... G06Q 30/0621 705/26.5
2019/0059474 A1 * 2/2019 Matsuura ..... A41D 15/005
2019/0174842 A1 * 6/2019 Kalkstein ..... A41B 7/06

FOREIGN PATENT DOCUMENTS

JP 1-66004 U 4/1989
JP 4-29606 U 3/1992
JP 2000265313 A 9/2000
JP 4537553 B2 6/2010
JP 4779085 B2 7/2011
WO 2013190686 A1 12/2013

* cited by examiner

L1=O'～m=1/2P×(0.177±0.005)
L2=M～m=O'm×1/4
O'～C=P×0.45
O～O'=P×0.15×0.1

C'～E=P×0.38
E～D=P×0.25+20
D～F=P×0.37
NT=MX

FIG. 7

SIZE TABLE 10

| | | | |
|---|---|---|---|
| (DATE AND TIME) 11 | (NAME) 12 | (BODY TYPE) 13 | |
| (FRONT ANGLE) 14 | (REAR ANGLE) 15 | (ANGLE) 16 | |
| (N) 17 | (M) 18 | (SUIT LENGTH) 19 | |
| (B) 20 | (CHEST) 21 | (SIDE) 22 | (BACK) 23 |
| (W) 24 | (FRONT) 25 | (REAR) 26 | |
| (H) 27 | (FRONT) 28 | (REAR) 29 | |

SUIT PATTERN AND MEASURING DEVICE FOR SUIT PATTERN

CROSS REFERENCE TO RELATED APPLICATION

This Application is a 371 of PCT/JP2015/067092 filed on Jun. 12, 2015, which is incorporated herein by reference.

TECHNICAL FIELD

The present invention relates to a suit pattern and a measuring device for suit pattern.

BACKGROUND ART

Conventionally, as for tailoring an outerwear of outfit, it is devised so that the outfit (outer wear) tailored while devising cutting of parts for sewing can be easily worn and that motion can be easily done in wearing the outfit.

For example, in the invention of Japanese Patent No. 4779085, based on an upper pattern formed by integrally cutting a collar portion and right and left sleeve portions and a lower pattern formed by integrally cutting a front body and a rear body, garment is formed by suitably joining a joining line of the collar portion in each pattern and a joining line of the left front body. Thereby, it can be provided the garment that weight saving thereof is realized, motion of wearer is not restrained, mobility is good and comfort with excellent workability and safety is good.

Further, in the invention of Japanese Patent No. 4537553, an arm member continuously formed to an upper portion of the front body and the back body is divided in a front arm member, a back arm member and a lower arm member, thereby a sleeve is formed from at least three members. Further, a shape of each arm member is curved in a predetermined direction, and the front body and a side edge portion attached to the back body are made in an intersecting state with an acute angle, thereby intersecting portion with an acute angle becomes a gusset, as a result, clearance necessary for motion is formed in a sewing state.

As mentioned, by cutting according to the above, the sleeve portion is formed into a three-dimensional shape near a curve state in which an elbow is lightly bent and an arm is put out obliquely forward in a lower direction, thereby wearing feeling of the outerwear becomes good against motion in the front, rear, left and right direction of the arm.

CITATION LIST

Patent Literature

PTL1: Japanese Patent No. 4779085
PTL2: Japanese patent No. 4537553

SUMMARY OF INVENTION

Technical Problem

However, in a case that the outerwear is sewed according to such sewing pattern or decomposition pattern of the sleeve portion, although the outerwear is securely excellent in comfort or ease of motion, there will be weakness in style point which is the most important concerning the outerwear such as suit or jacket and the like.

That is, it cannot be tailored a suit which matches with physical conditions of wearer in wearing state, for example, various conditions such as height, front-back inclination of the back (stoop, opposition), vertical balance of the right and left shoulders and the like and which fits to physical characteristic of wearer.

Further, in general suits, such suit is formed by sewing at back portions of a left half body part and a right half body part which are formed by separating the suit body in left and right from a back center line of the back portion. Further, each half body part is constituted by combining the front body and the back body. At that time, there are formed ready-made left and right half body parts so as to match with a body type of standard wearer as much as possible by measuring a length between both shoulders, a length of length, a bust length, a waist length, a sleeve length and the like, or left and right half body parts are formed for standard type of suit every body type classified in a plurality types, or there are formed left and right half body parts for tailoring which match with a body type of specific wearer based on values measured according to an order of specific person. Thereafter, the suit is formed based on such left and right half body parts.

However, parts of upper body measured in formation of suit are limited to parts traditionally specified from ancient times such as height, bust line, shoulder width, sleeve length and the like.

As mentioned in the above, in the conventional suit tailoring, it is not considered measurement of body parts necessary to best fit to the body type such as a slope of shoulder of wearer, a length of shoulder, a front inclination of back, a back opposition and the like and there is no technology to cut a pattern taking into consideration correlation between measurement results of such indispensable body parts and measurement results of the other body parts.

Therefore, it is desired a technology to easily form a suit by conducting pattern cutting based on measurement conducted so as to best fit to various body types of wearers.

For example, in measurement in conventional suit tailoring, even if measuring body part of wearer is increased and measurement is conducted in detail, it is necessary correlation between measurement results to best fit to body type, to realize the measurement results in cutting of each part in the left and right half body parts. Without consideration of such predetermined correlation, even if pattern cutting is simply conducted based on only measured values, a precise suit pattern cannot be formed.

The invention has an object to provide a suit pattern with a style through which left and right half body parts can be easily fitted to wearers having various body types, based on that a point becoming a base point of measurement body part of the wearer is made as a point provisionally determined from measurement values such as a chest circumference and the like; a height from the ground and the like in front and back of a body is taken into account as correction factor to such point; element of displacement such as various body types of wearers, especially opposition, slouch (stoop), shoulder line angle, length and the like is further taken into account, thereby a correct base point of measurement body part is determined; based on the correct base point, measurement value of each body part of the body type is calculated and reflected on the suit sewing.

Solution to Problem

The present invention provides a suit pattern comprising:

a left half body part and a right half body part formed by dividing a suit body into a left part and a right part along a back center line of a back portion;

left and right sleeve hole portions with an approximate ellipse shape formed in center upper portions of the left and right half body parts by partially cutting out;

a collar portion formed at a front edge portion of the left half body part;

a chest width portion in front of the sleeve hole portion;

a side width portion under the sleeve hole portion; and a back width portion behind the sleeve hole portion;

wherein the suit pattern is formed by joining and sewing respectively partial cutout portions of the left and right sleeve hole portions and back sewing lines of the left and right half body parts, wherein a point is moved forward from back base point to be an upper end of a back center line inherent for a wearer by a length calculated by adopting a correction formula ruled beforehand for a length of chest circumference or a length of neck rotation, wherein a point vertically moved upward by a length of approximate ¼ of a movement length from the moved point and specified is set to a provisional base point on a rear of a left and a right shoulders, wherein a point specified by an intersection of a vertical line at a position of approximate 0.5~0.6 times of a length to a front edge of the sleeve hole portion from a front edge of a front body and an absolute horizontal line from the provisional base point on the rear of the left and the right shoulders is set to a provisional base point on a front of the left and the right shoulders, wherein it is obtained a difference between a length of a curved neck line from the back base point of the back in a rear body to the provisional base point on the rear of the left and the right shoulders and a length from the back base point to a provisional standard point specified in a middle of the neck line, wherein a length from the standard point specified in the middle of the neck line by using a value of the difference to a ground surface passing through a back side of a body of the wearer and a length to the ground surface passing through a chest side are respectively corrected and a correct position of the base point on the rear of the left and right shoulders is specified, wherein a line connecting from a corrected right base point on the front of the left and right shoulders or the standard point in the middle of the neck line to a front edge of the cutout of the sleeve hole with a predetermined adjustment angle is set to a ridge line on the front of the left and right shoulders, wherein a line connecting from the corrected right base point on the rear of the left and the right shoulders or the standard point in the middle of the neck line to a front edge of the cutout of the sleeve hole with a respective shoulder inclination angle is set to a ridge line on the rear of the left and the right shoulders, and wherein the ridge line on the front of the left and the right shoulders and the ridge line on the rear of the left and right shoulders are joined and sewn.

Further, the correction formula adopted for the length of the chest circumference from the back center line when the base point on the rear of the left and the right shoulders is specified is that (0.15~0.20) is multiplied to approximate ½ of the length of the chest circumference.

Furthermore, the correction formula adopted for the length of the neck rotation from the back center line when the neck rotation is specified is that a total obtained by adding (10~15) to the neck rotation is divided by (5~7).

Furthermore, the present invention provides a measuring device for suit pattern comprising:

a curved frame 100*a* mountable along a rear neck rotation of a wearer;

left and right inclination plates 104, 105 supported through a support shaft at a left end portion and a right end portion of the curved frame 100*a*; and a ground height measuring device capable of measuring a length from base points (N, M) on the front and the rear of the left and the right shoulders set on a free end portion of the curved frame 100*a* to a ground surface GL;

wherein the curved frame has a left curved portion 101*a* and a right curved portion 102*a* which are independently formed and has an expansion and contraction mechanism in which one of base ends in the left curved portion 101*a* and the right curved portion 102*a* is made pluggable into the other of the base ends in the left curved portion 101*a* and the right curved portion 102*a*, wherein the ground height measuring device has an upper half portion measuring measure 121 suspended downward on the back side or the chest side from the base point (N, M) on the front and the rear of the left and the right shoulders, and has a weight 122 having reflection function which irradiates infrared ray on the ground surface GL and receives reflection from the ground surface GL, the weight 122 being formed at lower end of the upper half portion measuring measure 121.

As mentioned, the basic concept of the present invention is as follows.

That is, the chest circumference (length of neck rotation) of the wearer, which becomes an objective value, is measured and the correction formula is adopted for that, further the provisional base points on the front and the rear of the left and the right shoulders are set to a point apart from the objective back base point by a predetermined distance on the pattern paper. By taking into consideration for the positions of the provisional base points the factor of distance from the provisional standard point specified in the middle of the neck line to the ground surface while passing through the front and the back surface of wearer's body, the positions of the provisional base points on the front and the rear of the left and the right shoulders are corrected to the correct positions on the pattern paper, thereby the correct base points on the front and the rear of the left and the right shoulders are set on the pattern paper. By setting these correct base points on the front and the rear of the left and the right shoulders to original points for all sizes, points on the pattern paper necessary for the suit pattern are set.

That is, the present invention is characterized in that: when the suit pattern is formed, it is utilized various factors such as a computational value of the curved neck line calculated from the chest circumference and the like of the actual wearer and a length of distance from a provisional standard point in the middle of the neck line to the ground surface while passing through the front and back surfaces of the body. Based on this method, the left and right of the shoulder in the human body and the front and rear of the shoulder in the human body respectively become balancing posture of "balancing toy" while usually setting the back base point as the center, thereby it can be provided the suit having good comfort.

Advantageous Effects of Invention

According to the present invention, in the suit pattern necessary to form a normal suit, the provisional base points on the front and the rear of the left and the right shoulders are specified on both shoulders by a predetermined method, the correct base points are specified for the provisional base points taking the body type characteristic for the wearer into consideration, various sizes necessary for the suit such as the shoulder inclination, the length to the collar and the like are calculated based on the correct base points, thereby the suit pattern, namely, the pattern paper is formed. Concretely, the position of the provisional base point on the rear of the left shoulder is specified by adopting the predetermined correction formula to the chest circumference or length of the neck rotation of the wearer, next based on the length of the curved neck line between the back base point to be made the upper end of the back center line inherent for the wearer and the provisional base point on the rear of the left shoulder, the length from the specific standard provisional point in the middle of the neck line to the ground surface while passing through the chest side and the back side is corrected so as to increase or decrease, thereby the correct base point on the rear of the left shoulder is specified and the correct base point on the front of the left shoulder is specified from the correct base point on the rear of the left shoulder. Accordingly, it can be produced the suit fitting the characteristic body type to the wearer such as normal shoulders, shark's shoulders, stoop and opposition and the like and the pattern paper representing the measurement and the suit pattern can be easily produced, therefore there is an effect that the suit pattern exactly fitting to each body type of persons can be produced without highly skilled skill.

Since the suit produced by the above suit pattern exactly fits to the body type of the wearer and shoulder portions are made easy to work, there is an effect that unnecessary wrinkles do not occur in vicinity of neck rear portion or in the front and rear portions of the shoulders when wearing, therefore the suit fits in the left and right arms and smart wearing posture of the suit can be provided.

Especially, the base points on the front and the rear of the left and the right are provisionally specified while setting the length from the back base point along the neck line to the standard, thereafter the length from the ground surface is measured and the correct base points on the front and the rear of the left and the right shoulders are specified while correcting the measured values, further these base points are set as the standard points of various sizes necessary for the suit pattern. Therefore, the left and right shoulders of the suit becomes balanced shape utilizing the principle of "balancing toy" around the back base point and such suit can be fitted to any of the body type of the wearer.

BRIEF DESCRIPTION OF DRAWINGS

FIG. 7 is a size table according to the present invention.

DESCRIPTION OF EMBODIMENTS

Figure 1:
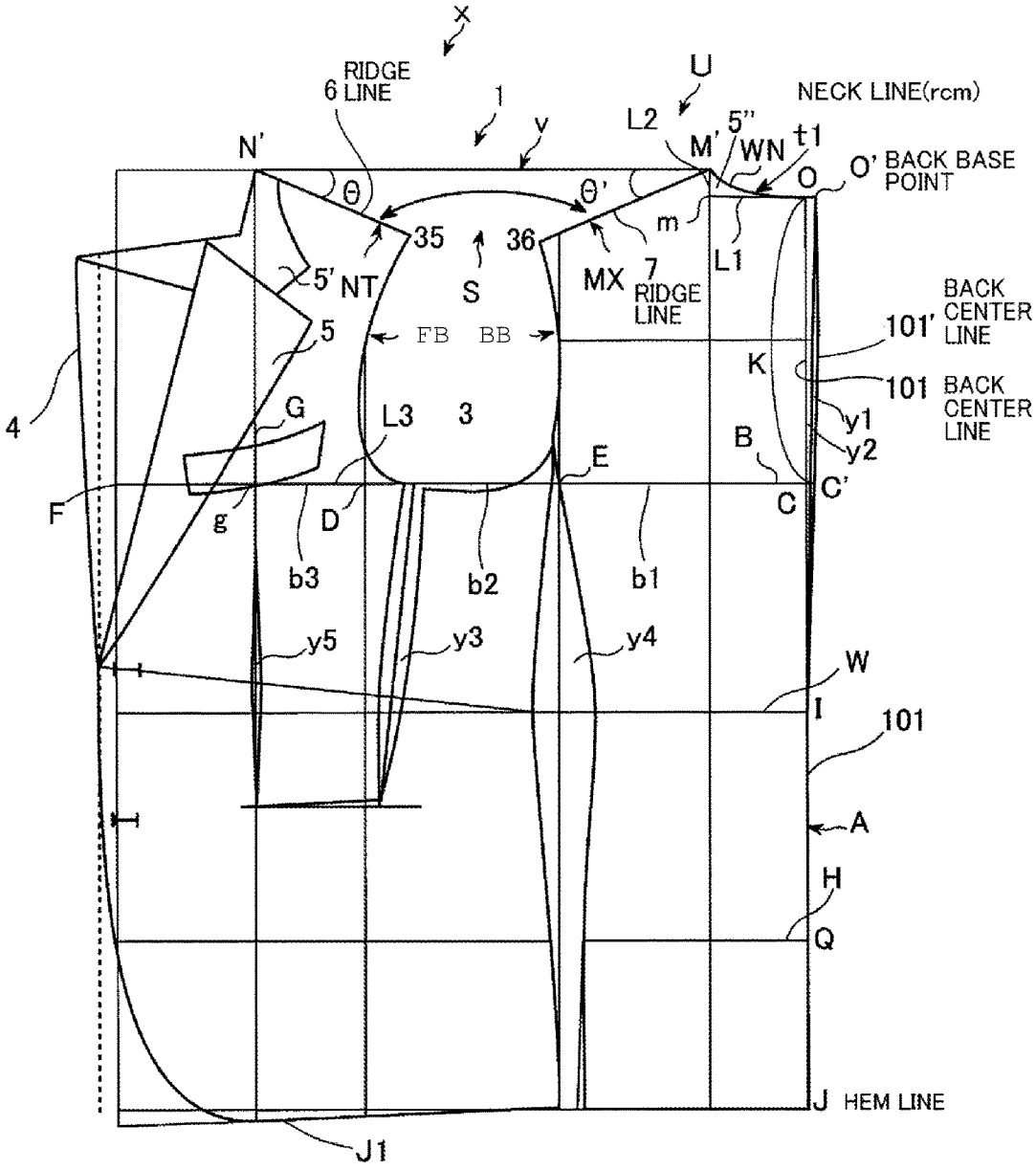
FIG. 1 is an exploded view showing a left half body part of the suit pattern according to the present invention.
Figure 2:
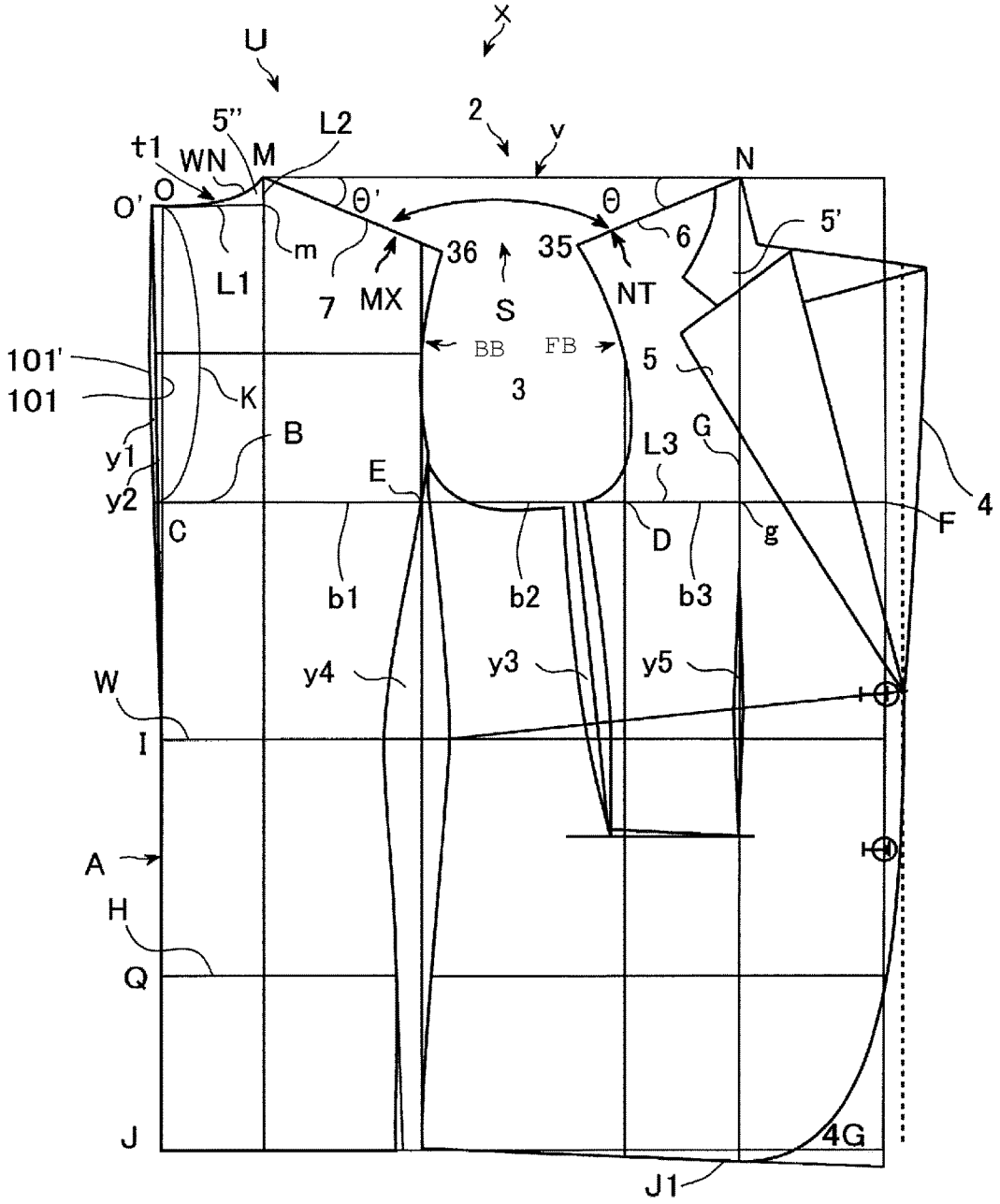
FIG. 2 is an exploded view showing a right half body part of the suit pattern according to the present invention.
Figure 3:
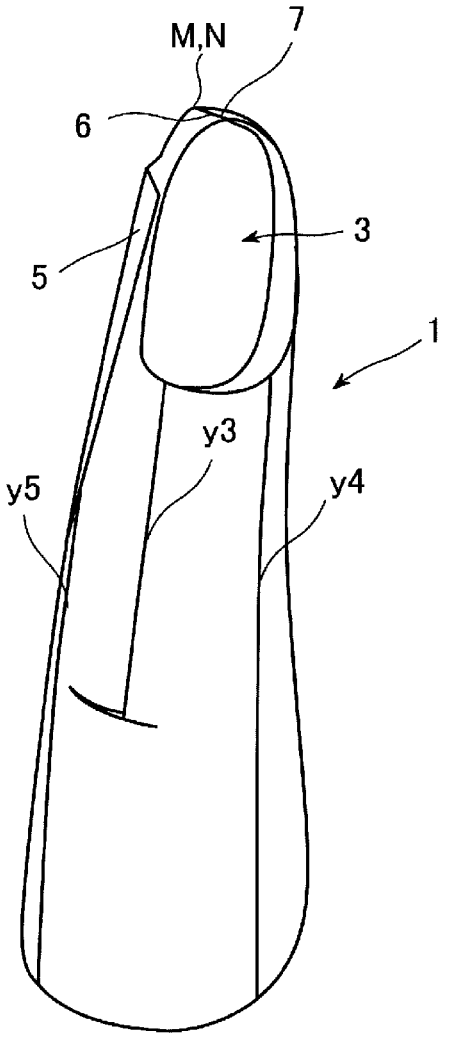
FIG. 3 is a three-dimensional side view of the suit pattern after sewing according to the present invention.

As shown in FIGS. 1 and 2, the embodiment of a suit pattern X according to the present invention is basically constituted from a left half body part 1 and a right half body part 2 formed by dividing an outerwear body 100 in left and right from a inherent back center line 101' of a wearer in a back, a sleeve hole portion 3 having an substantial eclipse shape formed by partially cutting out an upper portion of a center upper portion in each of the left and right half body parts 1, 2, a collar portion 5 formed by folding a front end portion 4 of a front body in the left half body part 1, a chest width portion b3 in front of the sleeve hole portion 3, a side width portion b2 under the sleeve hole portion 3 and a back width portion b1 rear the sleeve hole portion 3. The outer wear body 100 is formed by respectively joining and sewing cut out end portions S of the sleeve hole portion 3 and the back center lines 101 of each of the left and right half body parts 1 and 2.

Further, especially, a correct base point N on the front of the left and the right shoulders and a correct base point M on the rear of the left and the right shoulders are respectively specified on a shoulder portion of the left and right half body parts 1 and 2 while correcting various measurement values. Further, a line connecting the base point N on the front of the left and the right shoulders (a standard point in the middle of a neckline) and a cutout front end portion 35 of the sleeve hole portion 3 with an inclination angle θ of the shoulder is made a front shoulder ridge line 6 and a line connecting the base point M on the rear of the left and the right shoulders (a standard point in the middle of a neckline) and a cutout rear end portion 36 of the sleeve hole portion 3 with an inclination angle θ of the shoulder is made a rear shoulder ridge line 7.

Figure 4:
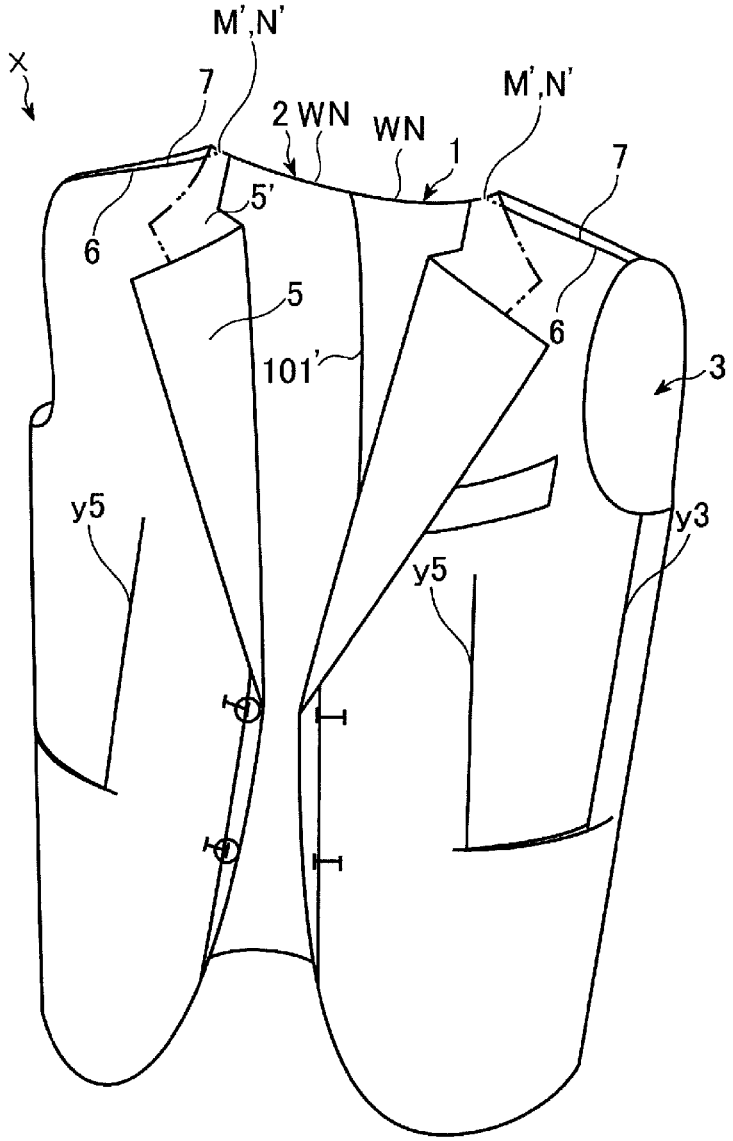
FIG. 4 is a three-dimensional perspective view of the suit pattern after sewing according to the present invention.
Figure 5:
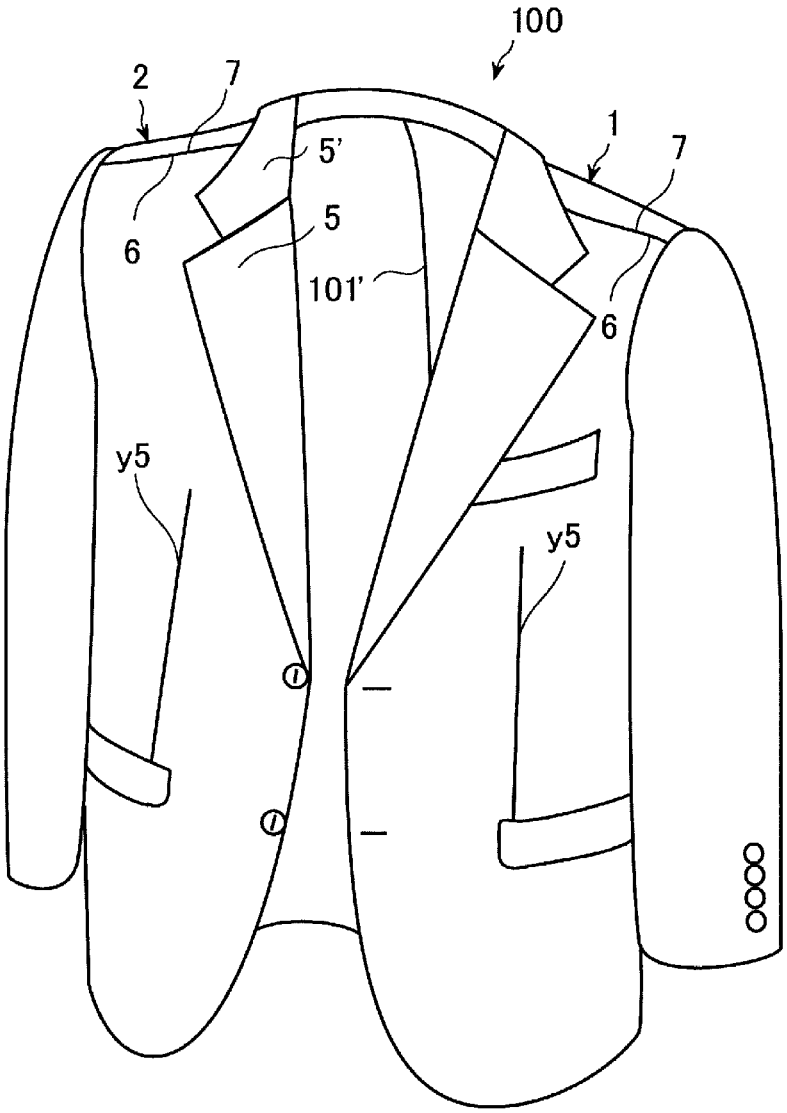
FIG. 5 is a perspective view of a suit formed by the suit pattern according to the present invention.
Figure 6:
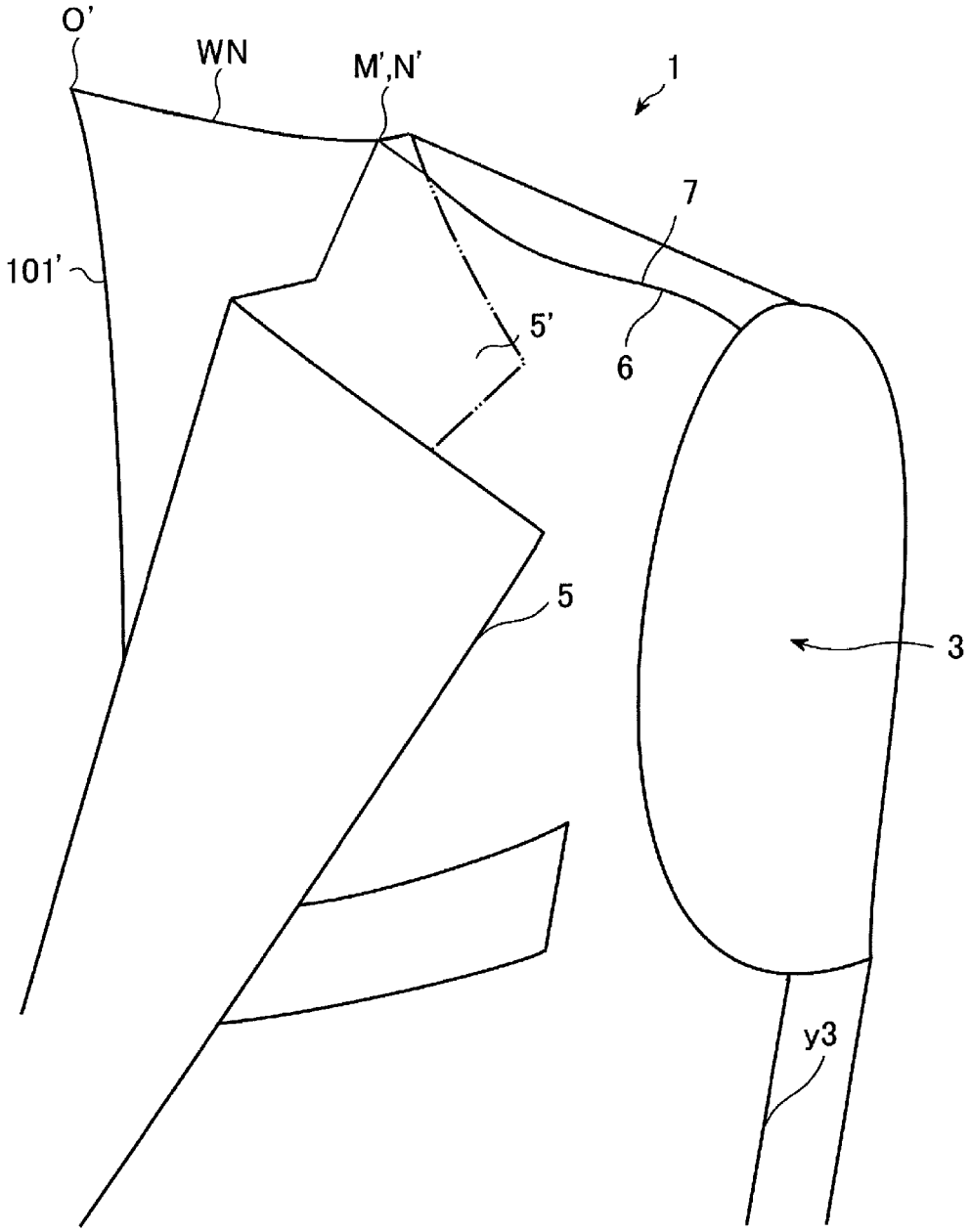
FIG. 6 is a partially enlarged view showing circumference of a base point on the rear of the left shoulder in the suit pattern according to the present invention.

Furthermore, when the suit pattern X is formed, the front shoulder ridge line 6 and the rear shoulder ridge line 7 are joined and sewed, thereby a three-dimensional suit pattern X (shown in FIG. 4) is completed.

Here, each of the left and right half body parts 1, 2 is basically constituted from a front body FB and a back body BB. Explaining by the left half body part 1 shown in FIG. 1, a front portion is made the front body and a back portion is made the back body on the border of a back edge portion of the sleeve hole portion 3. In actual cutting, each of the front body FB and the back body BB is independently cut, thereafter both front body FB and the back body BB are joined and sewn on a predetermined line, thus integrated.

As a sewing line of the front body FB and the back body BB, "the front shoulder ridge line 6 and the rear shoulder ridge line 7" and "seam allowance y4" are corresponds thereto. By sewing these, the front and back bodies FB and BB are integrated, thereby the left half body part 1 is formed.

Hereinafter, as for the suit pattern X concerning the left half body part 1 in constitution of the suit pattern X according to the present invention, an embodiment of formation of a pattern paper U will be described.

(1) Specification of Provisional Base Point M' on the Rear of the Left Shoulder (Step S1, S2)

First, specification of the provisional base point M' on the rear of the left shoulder (step S1, S2) is conducted. The provisional base point M' on the rear of the left shoulder is specified as follows. That is, a point positioned on an upper end of the back center line 101 of the back portion is set to a back upper end O, a point moved outward by "a length calculated so that ½ of the chest circumference length (=P) is multiplied by (0.177±0.005)" and further multiplied by 0.1 is set to a back base point O', a point is moved forward from the back base point O' by "a length L1 which is calculated by multiplying ½P of the chest circumference by (0.177±0.005)", further the provisional base point M' on the rear of the left shoulder is specified by vertically moving the above point upward by a length L2 which is substantially ¼ of movement distance from a movement point m (step S1, S2).

Here, in the provisional pattern paper U, although the measuring method to specify the provisional base point M' on the rear of the left shoulder is described, there may be a method in which a length of neck rotation PP of the wearer is made as the reference, other than the method in which the length of the chest circumference P is made as the reference.

That is, ""13" is added to the length of the neck rotation PP and a number calculated by dividing the total thereof by 6" is set to L1 and a point specified by vertically moving upward by the length L2 which is ¼ of L1 from the point m of L1 may be set to the provisional base point M' on the rear of the left shoulder.

That is, it is set to:

$$L1=(PP+13)\div 6, L2=L1\times 1/4 \text{ (step } S1, S2)$$

The provisional base point N' on the front of the left shoulder is a point specified by an intersection of a vertical line G of a vertical point g at a "position calculated by multiplying "a length L3 (F~D) from the front edge portion 4 of the front body to a side width point D of the front edge in the sleeve hole portion 3 by (0.56±0.05)" and an absolute horizontal line v from the provisional base point M' on the rear of the left and right shoulders.

As mentioned, although the detailed description concerns each line of the left half body part 1, description can be done for the right half body part 2 in exactly the same way. Thus, the left half body part 1 and the right half body part 2 are almost symmetrically formed. (see FIG. 2).

(2) Specification of Back Base Point O'

The position of the back base point O' is set to a point of the center portion on the border of the seventh cervical spine and the first thoracic spine when corresponding to the human skeleton While corresponding this back base point O' to the human skeleton, an angle of the shoulder is measured setting this point to the center and the provisional base points M', M' on the rear of the left and right shoulders in the embodiment and the provisional base point N', N' on the front of the left and right shoulders are determined. Further, the actual correct provisional points M, N are determined through various measured values and the correction values mentioned later and the left and right half body parts 1 and 2 are formed, thereby it can be formed the suit pattern which fits to the body type of each person without feeling burden when the wearer wears the suit.

Here, the seventh cervical spine is one of seven cervical spines and can be confirmed by a long spinous process protruded rearward by sense of touch. This seventh cervical spine is called as ridge in another name. Further, a spinous process of the first thoracic spine exists at a lower position of the long spinous process.

When the neck portion is moved, the upper spinous process (the seventh cervical spine) moves, but the lower spinous process (the first thoracic spine) never moves.

As mentioned, based on confirmation of the movable spinous process and the immovable spinous process through fingers by moving the neck portion, the positions of the seventh cervical spine and the first thoracic spine can be specified outside the human body.

Here, without using the back upper end O on the upper end of the back center line 101, the back base point O' of the inherent back center line 101' of the wearer is used as the base point for all sizes. The reason is as follows. In a case that the wearer wears the suit, the back portion is formed in the left and right curved surface. Therefore, it is necessary to take clearance portions for forming the curved surface, thus the back base point O' inherent for the wearer is used taking the clearance portions into consideration. A length between the back upper end O and the back base point O' is set to "L1×0.1 (1/10)".

(3) Specification Method of the Correct Base Points N, M on the Front and Rear of the Left Shoulder (a) The positions of the provisional base points M', M' on the rear of the left and right shoulders, the provisional base points on the front of the left and right shoulders N', N' are the positions in a case of the standard and exemplary body type without special body type such as opposition or passive of the wearer, therefore it has to conduct correction to these positions according to individual body type of the wearer and specify the correct base points N, M on the front and rear of the left shoulder.

Thus, to determine inherent "correct base point M on the rear of the left and right shoulders and the base point N on the front of the left and right shoulders" which become the standard for various sizes of the suit being most comfortable for the wearer, in the embodiment, the provisional base points M', M' and the provisional base points N', N' are determined by conducting physical measurement of the wearer. At the same time, the "provisional base point M on the rear of the left and right shoulders and provisional base point N on the front of the left and right shoulders" are set as the standard points and "correct base point M on the rear of the left and right shoulders and correct base point N on the front of the left and right shoulders" are derived by adding various correction factors on the basis of each base point. Such method is adopted.

Therefore, two kinds of a base point setting measure 30 and a height measuring measure 40 are prepared.

Figure 9:
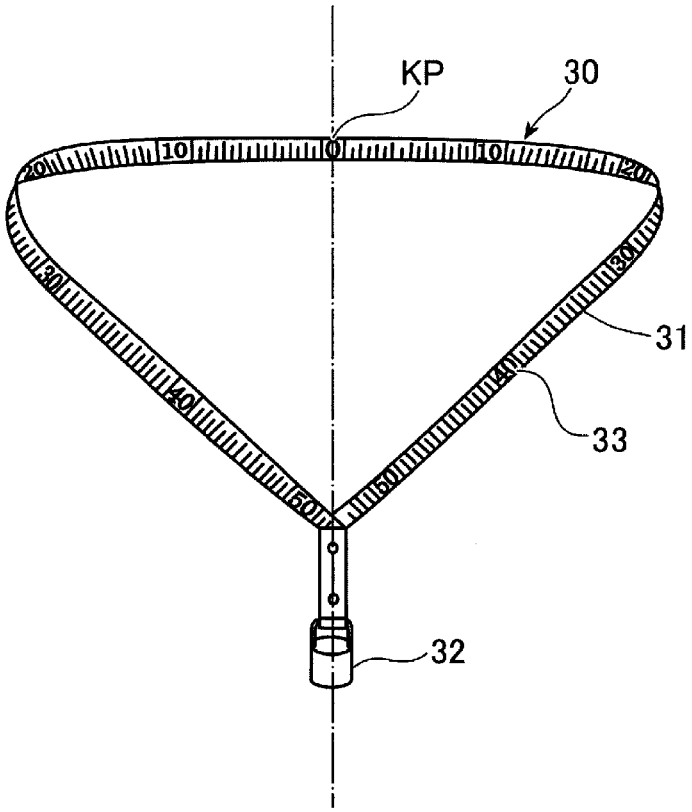
FIG. 9 is an explanatory view of a base point setting measure.

(b) As shown in FIG. 9, the base point setting measure 30 is constituted from a loop cord 31 and a weight 32 for the base point suspended at a center position of the loop cord 31 determined by provisionally bisecting the loop cord 31 and the other point determined by provisionally bisecting the cord 31, that is, a point positioned at the exactly opposite side of the weight 32 is set to a standard point KP. Furthermore, in the loop cord 31, a display scale 33 indicating length such as mm or cm and the like is written on the left and the right while setting one center point, that is, the standard point KP as a center.

Figure 10:
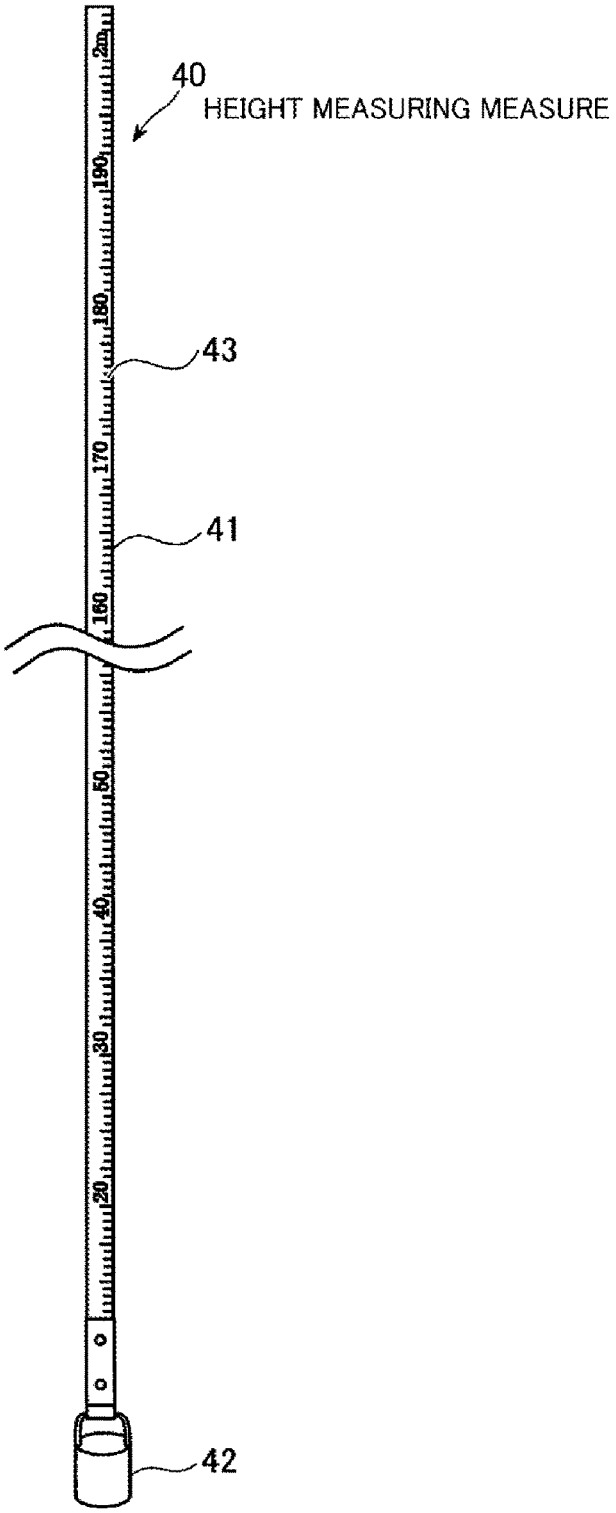
FIG. 10 is an explanatory view of a height measurement measure.

A height measuring measure 40, as shown in FIG. 10, is constituted from a long cord 41 to one end of which a weight 42 for height is concatenated and a display scale 43 indicating length such as mm or cm and the like to indicate a length from a bottom surface of the weight 42 is written in the long cord 41.

The weight 42 for weight gives tension to the long cord 41 when a length from the ground surface to the provisional base points on the front and rear of the left and right shoulders is measured, as mentioned later, thereby a correct length size can be obtained. The weight 42 realizes function as same as that of a falling weight used in measurement in civil engineering work.

Although the height measuring measure 40 is a device to measure a length from the ground surface (GL) to the points N, M on the front and rear of the left and right shoulders by utilizing tension of the long cord 41 through the weight 42 for height, it can be used a measuring device 120 for ground clearance in which electronic devices are utilized so as to be able to easily and correctly measure, as mentioned later.

Figure 8:
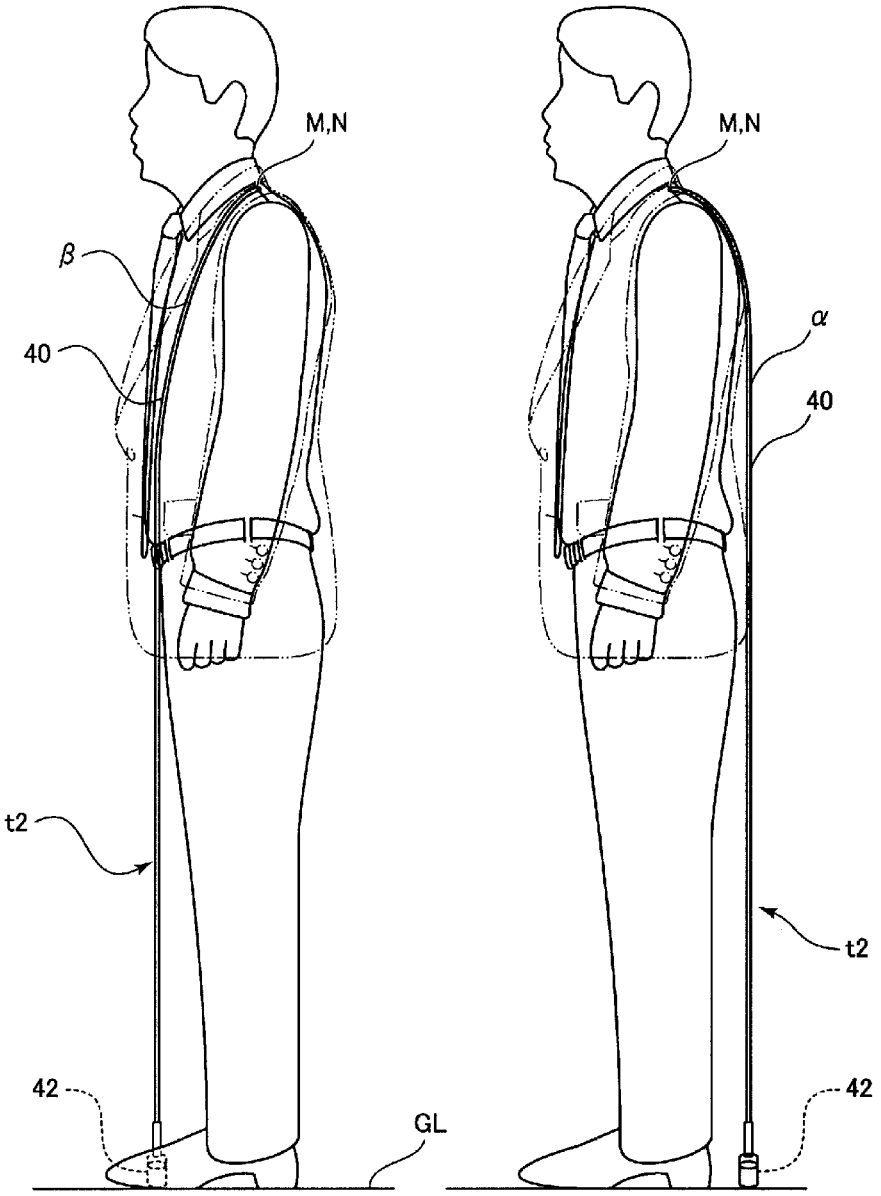
FIG. 8 is an explanatory view showing a measurement state of a length between provisional base points on the front and the rear of the left shoulder of the wearer and a ground surface GL.
Figure 11:
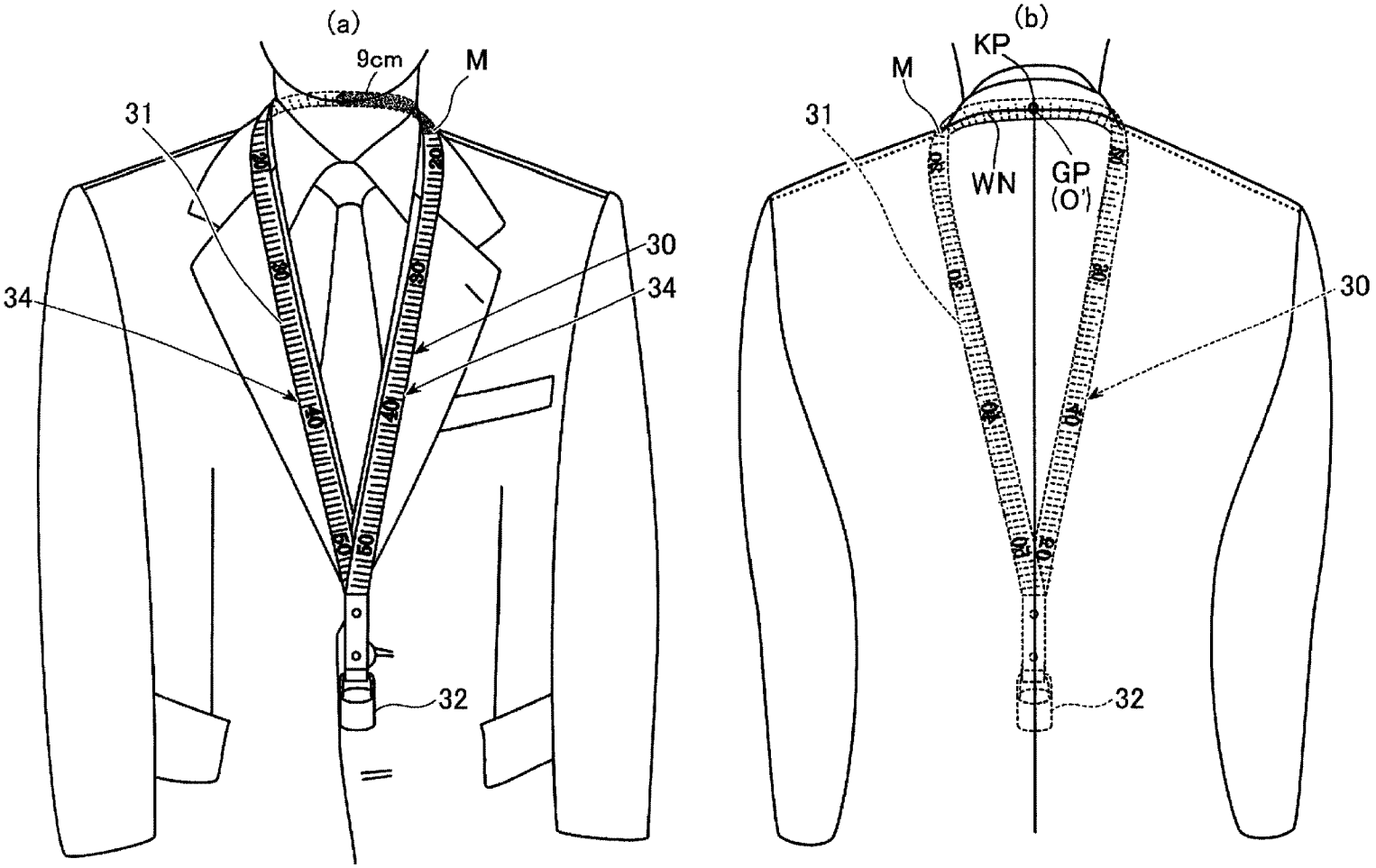
FIG. 11 is an explanatory view showing that the base point setting measure in a loop is suspended from a neck of the wearer.

Measured values obtained by using the base point setting measure 30 and the height measuring measure 40 constituted as mentioned in the above are utilized as shown in FIGS. 11 and 8, thereby utilized to correct positions of "correct base point M on the rear of the left and right shoulders and base point N on the front of the left and right shoulders" fitting to the body type of the wearer based on "provisional points N, M on the front and rear of the left and right shoulders". Finally, it is formed the pattern paper U including the correct positions of the base point M on the rear of the left and right shoulders and the base point N on the front of the left and right shoulders.

Here, in a case that the physical measurement of the wearer is conducted by the base point setting measure 30 or the height measuring measure 40, measurement is done under a state that Y-shirt Ya is worn after the suit is taken off. This principle is similar in a case that a slope of shoulder line is measured by the measuring device mentioned above or the distance from the base point N, M on the front and rear of the left and right shoulders to the ground surface GL is measured by using the measuring device 120 for ground clearance mentioned later, thus the measuring device is used in a state that the Y-shirt Ya is worn.

(c) Hereinafter, it will be described procedures to correct "provisional points N, M on the front and rear of the left and right shoulders" to "correct points N, M on the front and rear of the left and right shoulders" coinciding with the special body type of the wearer by using the base point setting measure 30 and the height measuring measure 40.

At first, the base point setting measure 30 in a loop is suspended to the wearer's neck. At that time, it becomes a state that the weight 32 for base point positions at the chest of the wearer.

This state corresponds to a state that the cord 31 in a loop is positioned and suspended from the neck to the chest, so to speak, left and right lines 34, 34 of the cord 31 in a loop traces left and right lines of the collar of the suit, thereby it concludes that V-shaped trajectory of the cord 31 is formed.

In this state, a back base point GP of the cord 31 coincides with a position of the back base point O of the wearer, that is, coincides with a position of the border center portion of the seventh cervical spine and the first thoracic spine of skeleton.

(d) Next, in the cord 31 suspended from the neck, "provisional separate position distant by 9 cm which is the provisional standard size" toward the left side (here, left half body part 1 is formed) from the back base point GP positioned to the back base point O' is set to the provisional base point M on the rear of the left and right shoulders and is set to the provisional base point N on the front of the left and right shoulders (the base point M on the rear of the left and right shoulders and the base point N on the front of the left and right shoulders are provisionally determined as one point since the base point M and the base point N naturally match with each other) (step 4).

(e) Thus, to set the provisional position of the provisional base point M' on the rear of the left and right shoulders of the wearer on the pattern paper U, as described above, it is calculated the length L1 obtained by multiplying ½P of the length of the chest circumference from the back base point O' of the back center line inherent to the wearer by (0.177±0.005) and the point is moved forward by the length L1. Further, the point is vertically moved upward by the length L2 which is approximately ¼ of the movement length from the moved point m. Such point is set to the provisional base point M' on the rear of the left and right shoulders.

That is, by measuring ½P of the length of the chest circumference of the wearer, the position of the provisional base point M' on the rear of the left and right shoulders is naturally specified on the provisional pattern paper. Based on this, it is calculated a length rcm of neck line WN of the curved line between the back base point O' and the provisional base point M' on the rear of the left and right shoulders on the provisional pattern paper (in other words, a length from the standard point KP in the base point setting measure 30 suspended from the wearer's neck to the position of the provisional base point M moved to the left side direction) (step S3).

The position of this length rcm of the neck line WN corresponds to the position of the provisional base point M' on the rear of the left and right shoulders and the position of the provisional base point N' on the front of the left and right shoulders based on actual measurement against the wearer.

The positions of the base point M', the base point N' are the computational positions in a case of the wearer having the ideal and upright immovable standard body type without opposition or stoop, therefore considering specialty of the body type of the wearer, it is necessary work to correct the positions of the base point M', the base point N' based on the specialty of the body type of the wearer to the correct positions of the base points N, M on the front and rear of the left and right shoulders compatible for the wearer himself/herself. This correction work will be described hereinafter.

Here, the important thing is as follows. That is, it is determined which points on the body type of the wearer correspond to the correct base points N, M on the front and rear of the left and right shoulders taking specialty of the wearer into consideration, and to represent this on the pattern paper, the position of the provisional size 9 cm in the cord 31 in a loop is set to "provisional base points N, M on the front and rear of the left shoulder". Further this position is set to the position of the provisional base point N, M on the front and rear of the left shoulder in the provisional pattern paper U (step S4).

That is, in the pattern paper U, the position of the provisional base point M' on the rear of the left shoulder is, as described above, moved forward from the back base point O' by the length L1 obtained by multiplying ½P of the length of the measured chest circumference of the wearer by (0.177±0.005) and the provisional base point M' is provisionally determined as the point vertically moved upward by the length L2 which is approximately ¼ of the movement length from the moved point m or the point specified by measuring from the neck rotation. Especially, in a case that the curved line connecting the back base point O' and the provisional base point M' on the rear of the left shoulder is made the neck line WN, since the neck line WN of this curved line becomes the shape coinciding with the collar line of the cord 31 in the base point setting measure 30 suspended from the neck, the position separate by the provisional size 9 cm of the neck line WN from the back base point O' is tentatively set to the provisional position of the base point M on the rear of the left shoulder in the left shoulder of the wearer (step S4).

On the other hand, the computational length rcm of the neck line WN in the pattern paper U is an objective computational length derived based on the above calculation from actual measurement of the chest circumference of the wearer. Therefore, originally, in a case of the wearer having completely standard body type without opposition or stoop, this curved length rcm is a length to the originally correct base point M on the rear of the left shoulder from the back base point O' in the cord 31 in a loop.

Therefore, taking special characteristic such as opposition or stoop of the wearer into consideration, it is necessary to determine which point on the body type of the wearer is the correct base point N, M on the front and rear of the left shoulder.

Thus, to determine the correct position of the base point M on the rear of the left shoulder on the pattern paper U, in the position of the provisional measurement base point M−1 of the left shoulder set to the position of the standard size 9 cm in the cord 31, the length from the ground surface (GL) is measured on both sides of the back side and chest side of the wearer (step S6).

It is measured by the height measuring measure 40 the length from the ground surface (GL) to the provisional measurement base point M−1 on the rear of the left and right shoulders and the provisional measurement base point N−1 on the front of the left and right shoulders. This measurement is conducted as follows. That is, the length α from the ground surface (GL) to the provisional measurement base point M−1 on the rear of the left and right shoulders is measured on the back side (rear side) of the wearer and the length β from the ground surface (GL) to the provisional measurement base point N−1 on the front of the left and right shoulders is measured on the chest side (front side) of the wearer (step S6).

Here, instead of the height measuring measure 40, it can be measured by the measuring device 120 for ground clearance the length α from the ground surface (GL) to the provisional measurement base point M−1 on the rear of the left and right shoulders and the length β from the ground surface (GL) to the provisional measurement base point N−1 on the front of the left and right shoulders. The measuring device 120 for ground clearance is constituted as follows.

Although the length α from the ground surface (GL) to the provisional measurement base point M−1 on the rear of the left and right shoulders is measured along the back side (rear side) of the wearer and the length β from the ground surface (GL) to the provisional measurement base point N−1 on the front of the left and right shoulders is measured along the chest side (front side) of the wearer, for the above reason, it is utilized a curved frame 100*a* used for measuring inclination angle of the shoulder of the wearer mentioned in the above.

That is, when the inclination angle of shoulder ridge line is measure by a measuring device Z, the curved frame 100*a* is put on the rear neck K of the wearer and a free end portion of the curved frame 100*a* is put on corresponding to the provisional base point (N−1, M−1) on the front and rear of the left and right shoulders, thereby the angle of the shoulder ridge line is measured by swing angle of left and right inclined plates 104, 105. Therefore, in a state that the curved frame 100*a* is mounted on the neck, it can be utilized the measuring device 120 for ground clearance in which electronic devices are utilized to measure the length α,β along the back • chest portion to the ground surface (GL) from positions of left and right free end portions 100*a*', 100*a*", that is, positions of the provisional measurement base points (N−1, M−1) on the front and the rear of the left and right shoulders.

The measuring device 120 for ground clearance is constituted so that an upper end of upper half measuring measure 121 is connected to the left and right free end portions of the curved frame 100*a* and a weight 122 with reflection function is provided to a lower end of the measure 121.

The upper half measuring measure 121 is constituted from flexible material so as to go along the back, chest portion of the wearer and the flexible upper half measuring measure 121 is formed in the short length so that the lower end thereof reaches substantially midstream of the chest side or the back side. The upper half measuring measure 121 is suspended downward from the provisional measurement base points (N−1, M−1) on the front and rear of the left and right shoulders.

The weight 122 with reflection function has a transmitting unit 124-1 reflecting infrared ray or ultrasonic wave and the like and a receiving unit 124-2 receiving such reflection, both transmitting unit 124-1 and the receiving unit 124-2 being provided on a lower end surface of a weight case 123.

Therefore, in a case that the length of the upper half measuring measure 121 is set to the short length, for example, 1 m, this measure 121 is easily suspended along the chest portion and back portion of the wearer from the provisional measurement base point (N−1, M−1) on the front and rear of the left and right shoulders. Next, based on that a reflection time of infrared ray and the like transmitted from the weight 122 with reflection function from the ground surface (GL) is measured, the distance from the weight 122 with reflection function to the ground surface (GL) is measured. Further, it concludes that the length obtained by adding 1 m length of the upper half measuring measure 121 to the measured distance becomes the length α or β from the provisional measurement base points (N−1, M−1) of the wearer to the ground surface along the chest side or the back side of the wearer.

That is, it can be simply, easily and correctly measured the length from the provisional measurement base points (N−1, M−1) to the ground surface (GL) along the chest side or the back side of the wearer by the upper half measuring measure 121 with short length.

Here, in a case that the wearer has the body type of forward bending attitude (that is, stoop), it exists a relation of $\alpha>\beta$.

Supposed that GL~M−1=$\alpha$, GL~N−1=$\beta$, the difference of $\alpha$ and $\beta$ is utilized as a factor for position correction of the provisional measurement base point M−1 on the rear of the left and right shoulders, the provisional measurement base point N−1 on the front of the left and right shoulders, both being supposed on the basis of the provisional standard size 9 cm (that is, correction to the correct base point M, the correct base point N).

Next, the difference (difference of $\alpha$ and $\beta$) is obtained and this difference of $\alpha$ and $\beta$ is utilized for position correction of the base point M on the front of the left shoulder (step S7).

For that reason, before measurement of $\alpha$ and $\beta$ in step S6 is conducted beforehand, it is obtained a difference (LX) of the provisional standard size 9 cm and the computational length of the neck line WN (supposed that the length of the neck line WN is 8.5 cm, 9 cm−8.5 cm=0.5 cm) (step S5).

Further, the difference of 0.5 cm (LX) is utilized as a variable factor of the base point M', N' on the rear of the left and right shoulders (step S7).

That is, since on the basis of the back side measured value, in a case that the wearer has the body type of forward bending attitude, LX of 0.5 cm is added to a, LX of 0.5 cm is subtracted from $\beta$ and new values of $\alpha$ and $\beta$ are added to the computational base point M', N'. As a result, it can be determined the positions of the correct base point M on the rear of the left shoulder and the correct base point N on the front of the left shoulder based on the actual size of the wearer having specialty of opposition, stoop and the like.

In a case that the correct base point M on the rear of the left shoulder is specified, position specification of the base point N on the front of the left shoulder is, as described above, specified by an intersection of the vertical line G of the vertical point g positioned at about (0.56±0.05) of the length L3 (F~D) to the armpit width point D of front edge of the sleeve hole portion 3 from the front edge portion 4 of front body and the absolute horizontal line v from the base point M on the rear of the left shoulder the position specification of which is already conducted.

Therefore, on the pattern paper U, by adding correction on the ground clearance (a) of the provisional measurement base point M−1 on the rear of the left shoulder, such ground clearance is set to $\alpha'$, as a result, the upper portion of the rear body becomes a shape extended upward according to correction of the above ground clearance or a shape shortened downward by the body type. Similarly, by adding correction to the ground clearance ($\alpha$) of the provisional measurement base point N−1 on the front of the left shoulder, such ground clearance is set to $\alpha'$, as a result, the upper portion of the front body FB becomes a shape stretched in the upper and lower direction according to correction. Thus, it concludes that the correct base points N, M on the front and rear of the left shoulder are first specified.

Here, to obtain the inclination angle $\theta,\theta'$ of the shoulder, the inclination angle of the shoulder is measured from the provisional measurement base points M−1, N−1 of the standard size 9 cm point set beforehand. That is, the line connecting the cutout front end portion of the sleeve hole portion 3 with a predetermined adjustment angle, that is, the inclination angle $\theta$ of the shoulder from the measurement base point N−1 on the front of the left shoulder is set to the front shoulder ridge line 6. Further, the line connecting the cutout front end portion with a predetermined adjustment angle, that is, the inclination angle $\theta'$ of the shoulder is set to the rear shoulder ridge line 7 in the left and right direction (step S8).

Figure 20:
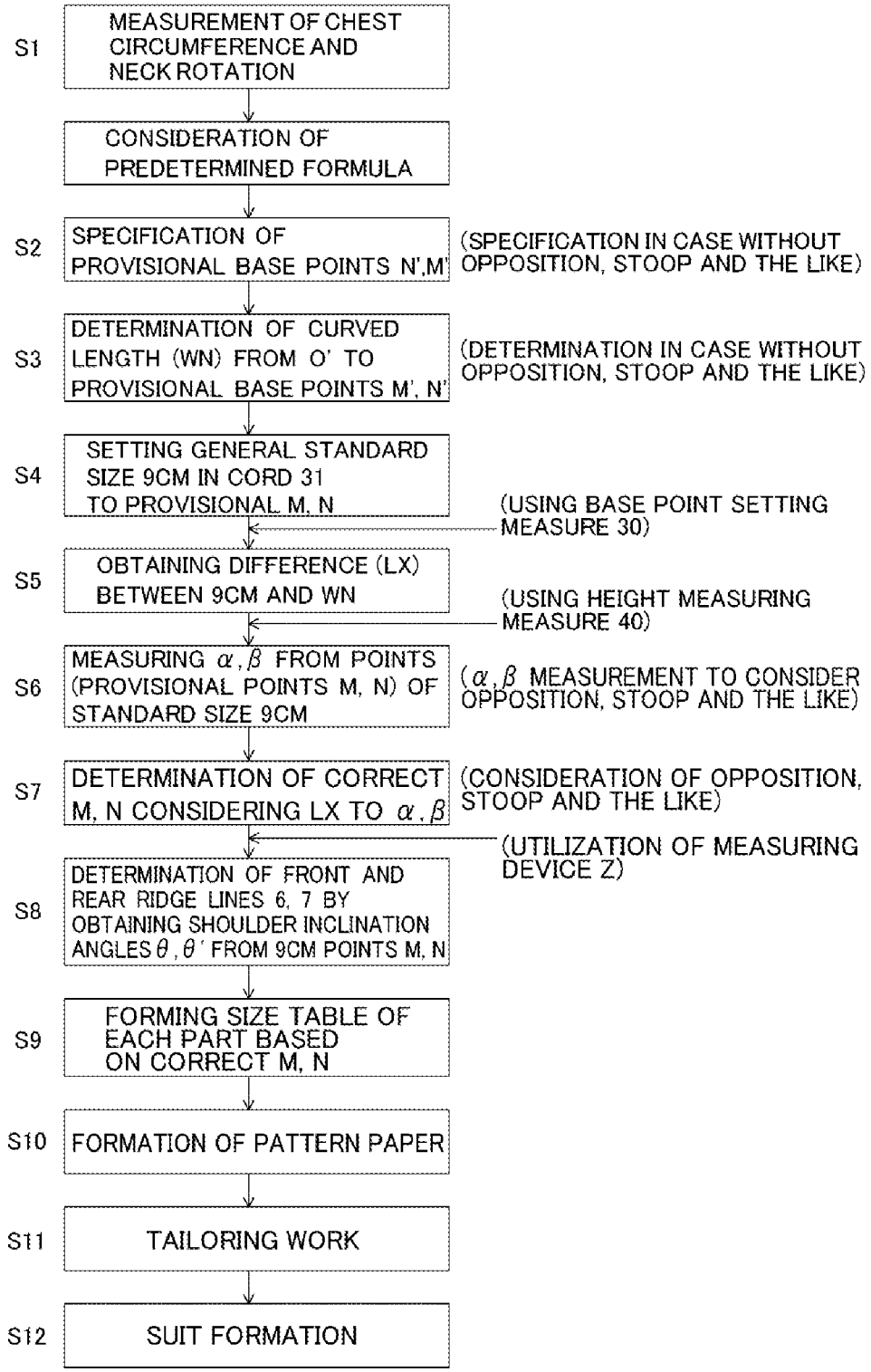
FIG. 20 is an explanatory view showing a flowchart of formation process of the suit pattern according to the present invention.

As for the measurement time of the inclination angle of the shoulder, in the present embodiment, such measurement time is described at the timing of S8 in FIG. 20. However, for example, such inclination angle of the shoulder may be measured between step S4 and step S5 in FIG. 20. That is, after the point of the standard size 9 cm is set as the provisional base point M−1, N−1, the inclination angle $\theta,\theta'$ of the shoulder may be measured.

Here, the front shoulder ridge line 6 with a predetermined inclination angle $\theta$ from the measurement base point N−1 on the front of the left shoulder and the rear shoulder ridge line 7 with a predetermined angle $\theta'$ from the measurement base point M−1 on the rear of the left shoulder has the adjustment angle of 23 degrees in normal standard angle. However, the shoulder line of the wearer is actually determined by a measuring device such as protractor and the like.

Figure 12:
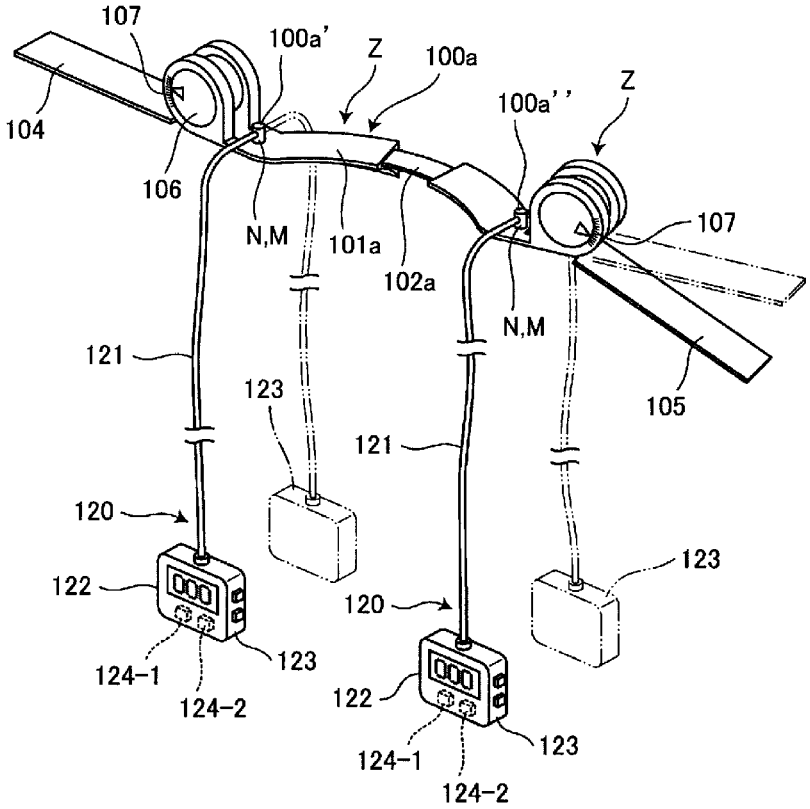
FIG. 12 is a perspective view of a measuring device according to the present invention.
Figure 13:
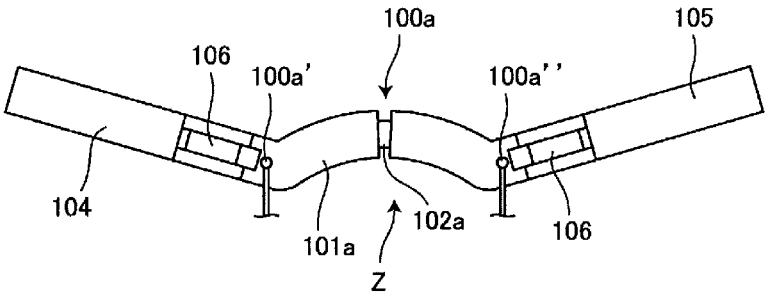
FIG. 13 is a plan view of the measuring device according to the present invention.
Figure 14:
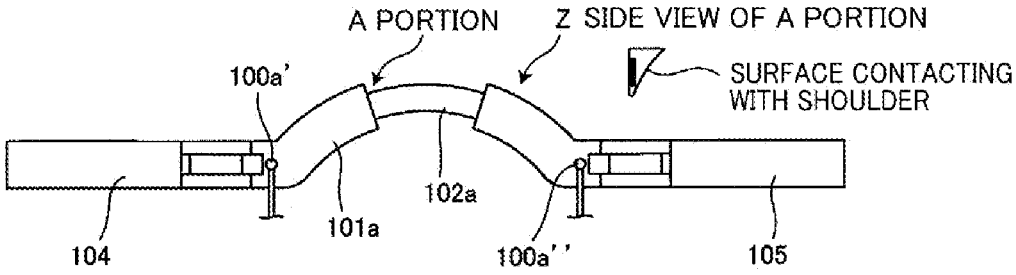
FIG. 14 is a plan view of the measuring device according to the present invention.
Figure 15:
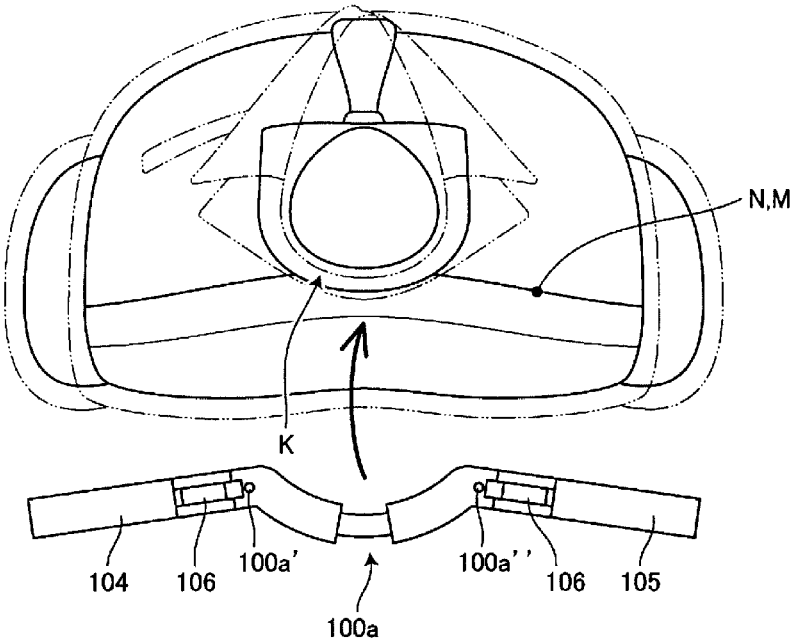
FIG. 15 is an explanatory view showing a state that the measuring device of the present invention is used.
Figure 16:
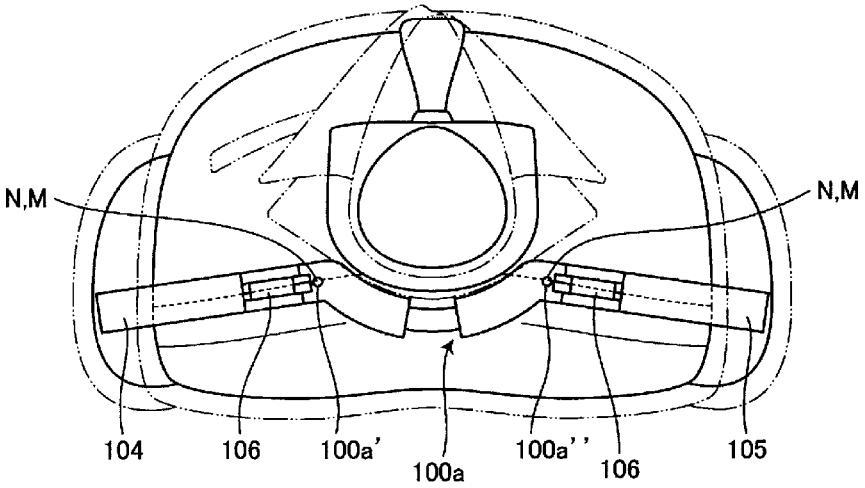
FIG. 16 is an explanatory view showing a state that the measuring device of the present invention is used.
Figure 17:
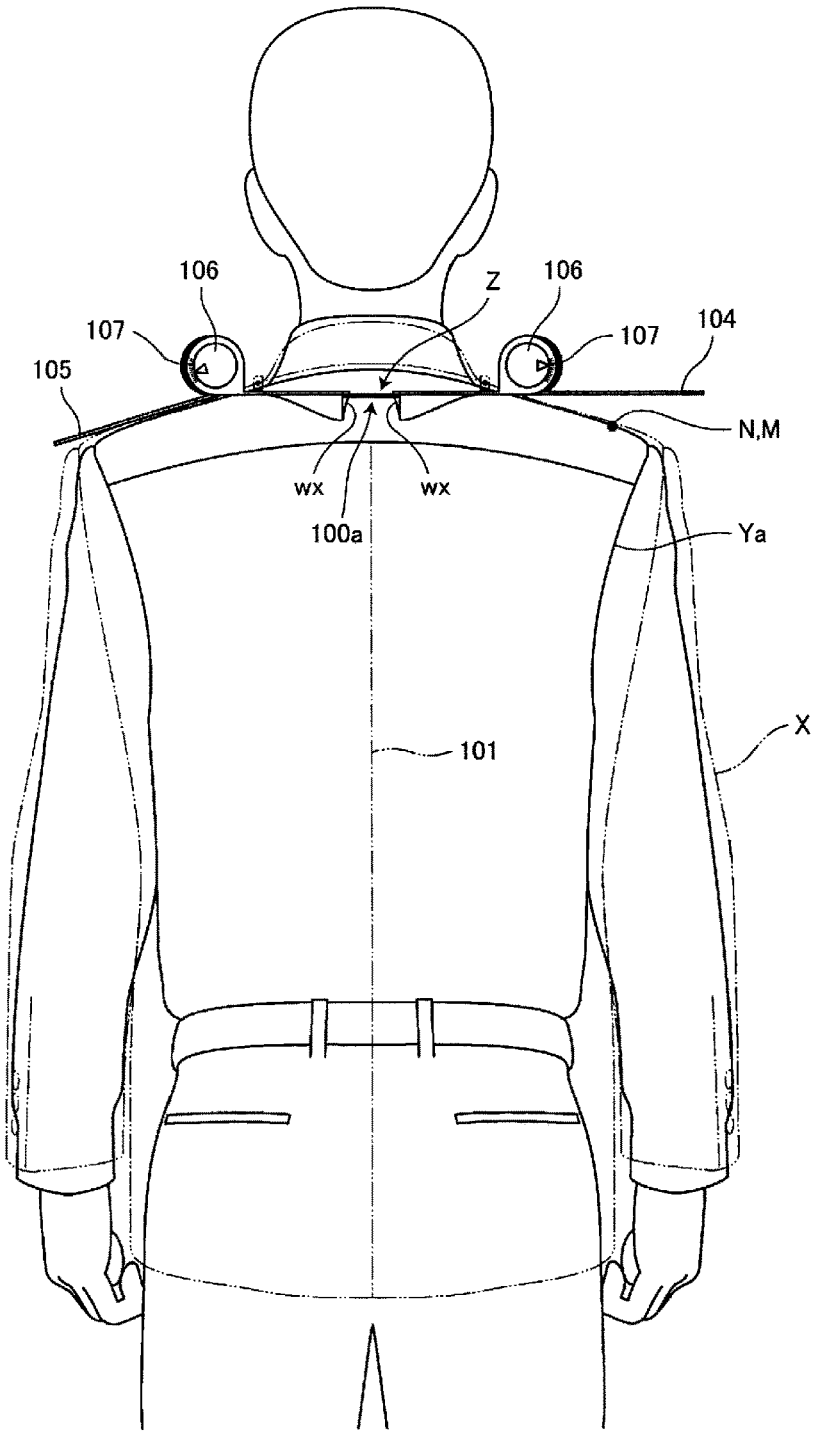
FIG. 17 is an explanatory view showing a state that the measuring device of the present invention is used.
Figure 18:
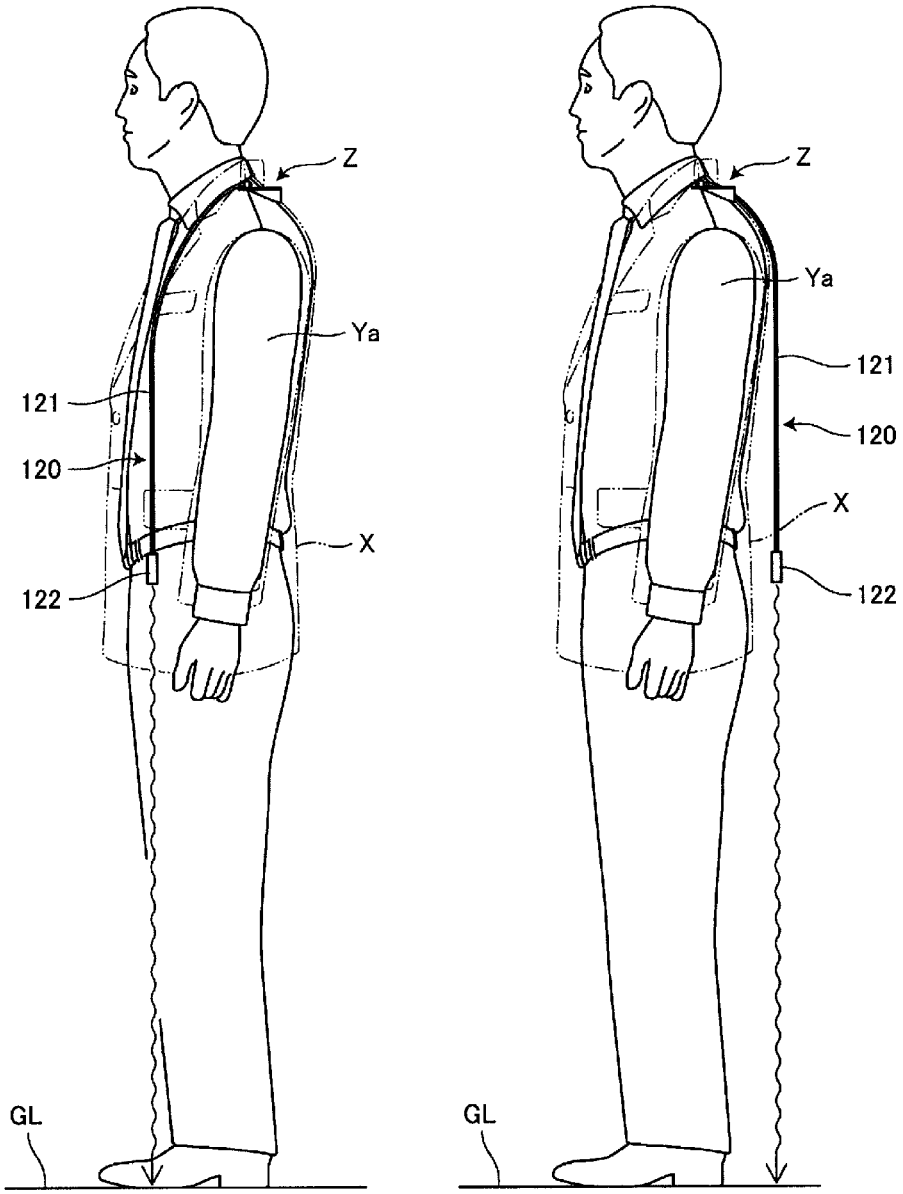
FIG. 18 is an explanatory view showing a measurement state of a length between provisional base points N, M on the front and the rear of the left shoulder of the wearer using the measuring device of the present invention and a ground surface GL.

Here, as shown in FIG. 12~FIG. 14, when the shoulder line of the wearer is measured by the measuring device such as protractor, the inventor devised a measuring device Z through which the shoulder line can be simply and correctly measured.

That is, as shown in FIG. 12~FIG. 14, it is first provided the curved frame 100*a* capable of mounting around the rear neck of the wearer and both ends 100*a*', 100*a*" of the curved frame 100*a* are constituted so that each end corresponds to the position of M, N match point matching with the base point M on the rear of the left shoulder and the base point N on the front of the left shoulder, both being provisionally specified and the position of M, N match point matching with the base point M on the rear of the right shoulder and the base point N on the front of the right shoulder, both being provisionally specified.

The positions of the point M, N in the left and right direction change in the left and right direction due to the skeleton or shoulder width of the wearer, therefore the curved frame 100*a* has a retractable structure at the left and right ends. For example, the left half of the curved frame 101*a* and the right half of the curved frame 102*a* are independently constituted, and it is adopted a BR>L shrinking mechanism that in one base end of the left half of the curved frame 101*a* or the right half of the curved frame 102*a*, the other base end of the left half of the curved frame 101*a* or the right half of the curved frame 102*a* is pluggable.

Here, the lower end surface of the curved frame 100*a* has a shape contacting around the rear neck as much as possible as slightly inclined inflection surface wx as shown in FIG. 14 showing a side view of A portion, so that the sectional shape of the curved frame 100*a* contacts around the rear neck of the wearer.

Further, at the left and right end portions of the curved frame 100*a*, there are provided the left and right inclined plates 104, 105 capable of rocking freely to measure an inclination angle of the shoulder ridge line.

That is, base end portions of the left and right inclined plates 104, 105 are supported through support shafts 106 at the left and right end portions of the curved frame 100*a*.

The left and right inclined plates 104, 105 are rock around the support shafts 106, therefore, to measure the absolute inclination angle due to rocking, measuring scales 107 to measure the inclination angle from the absolute horizontal position are added to the portion of the support shaft 106.

Further, to measure the inclination angle of the left and right inclined plates 104, 105, it may be constituted so that a digital display portion is provided instead of the above measuring scale 107 and rocking of the left and right inclined plates 104, 105 is electrically detected, thereby the inclination angle is displayed on the digital display portion. In this case, a power supply part, a control part and a leveler mechanism are built in the curved frame 100*a*, rocking of the left and right inclined plates 104, 105 is electrically detected and the inclination angle of the left and right inclined plates 104, 105 is displayed.

When using, as shown in FIG. 15~FIG. 18, the curved frame 100*a* is set on the rear neck K of the wearer, the left and right end portions of the curved frame 100*a* are positioned so as to match coincident points of the base points M, M on the rear of the left and right shoulders and the base points N, M on the front of the left and right shoulders. Continuously, the left and right inclined plates 104, 105 are put on the ridge lines of the left and right shoulders from the base points M, M on the rear of the left and right shoulders and the base point N, N on the front of the left and right shoulders and the inclination angle of the left and right inclined plates 104, 105 tilting around the support shaft 106 is measured by the measuring scale 107 or the electrical detection method.

(4) As for Bust Line B, Waist Line W, Hip Line H and Hem Line J

The left half body part 1 forms a bust line B, a waist line W, a hip line H and a hem line J at positions apart by a predetermined distance from the upper edge.

The bust line B is shown as clearance in a horizontal line from a bust point C positioned in a lower direction by a length obtained by multiplying ½P of the chest circumference length by approximate 0.45 from the back base point O' of the back center line 101' inherent for the wearer O'~C=P× 0.45).

Here, ½P of the chest circumference length is a value obtained by adding (6 cm±2) cm to ½P' of the chest circumference actually measured (P=P'cm±(6 cm±2)).

Further, a vertical length of O'~C is set to the height K.

Actually, to make clearance y1 of the horizontal width in the line of the height K of O'~C, the back base point O' is widened from the back center line 101 at the point obtained by multiplying the ½P of the chest circumference length by approximate 9.15 and 0.1 (O~O'=P×0.15×0.1).

Similarly, clearance y2 of 2 cm from the bust point C of the bust line B is formed.

From C' (bust clearance point) at which the clearance y1 is removed from the bust point C of the bust line B, a point of length obtained by multiplying 1.2P of the chest circumference length by approximate 0.38, that is, the point to the rear edge of the sleeve hole portion 3 is set to the back width point E (C'~E=P×approximate 0.38).

Here, the horizontal width of c'~E is set to a back width portion b1.

A point of length obtained by multiplying ½P of the chest circumference length by approximate 0.25 from the back width point E of the rear edge position of the sleeve hole portion 3 in the bust line B, that is, the point to the front edge of the sleeve hole portion 3 is set to a side width D and the horizontal width of D~E is set to a side width portion b2.

Here, it is included in E~D a width (5 mm) of a seam allowance y4 in the joining portion of the front body and the rear body and a width (15 mm) of lower aside darts y3 under sleeve hole portion in the front body (E~D=P×0.25+20 mm).

A button position of the front edge of the front body FB of the outerwear body 100 is set to a button point F and a length obtained by multiplying ½P of the chest circumference length by approximate 0.37 becomes a horizontal width of D~F, this is set to a chest width portion b3 (D~F=P× approximate 0.37).

In the bust line B, a point of length obtained by multiplying the length of D~F by approximate 0.56 in the middle of D~F is set to a vertical point g, further the upper end of the vertical line G of the vertical point g becomes a base point N on the front of the left shoulder.

The waist line W is a horizontal line of the midpoint of the bust line B and the hip line H, that is, is a horizontal line of a waist point I of (B−H)×½. Hip line H is a horizontal line at a hip point Q obtained by multiplying a length, that is, a length to the hem line L from the back base point O' by approximate 0.184.

Here, in figures, y5 is the front darts indicating clearance under the collar.

Further, R indicates a breast pocket.

5' is a neck collar portion concatenated and sewn to the upper end of the collar portion 5 and is concatenated and sewn to an upper end portion (5") of the back width portion b1 other than the shoulder ridge lines 6, 7 in the front and rear.

Further, the hem line J is formed by falling down a hem line J1 of the front body by 1.5 cm and the hem line J appears totally horizontal when the suit is worn, thereby good appearance of the suit is wholly realized.

In a case that the suit pattern X is formed by sewing the left half body part 1 and the right half body part 2, it can be adjusted by the value of the chest circumference length P whether the suit is constituted so as to perfectly fit to the body shape of the wearer in taste or so as to fit in a relaxed manner.

That is, in the above embodiment, although it is described as P=P'+(6±2), it can be adjusted in a range from (P=P'+4) to (P=P'+9), and when P is adjusted according to the above, the value and position of O~C, O~O', C'~E, E~D, D~F, M, N are changed.

(5) Size Table (Step S9)

Actually, to produce the left half body part 1, it is necessary to measure sizes of the body type of the wearer.

It is indicated in FIG. 7 a size table 10 for filling out various measured sizes and various columns are provided in the size tale 10 as follows.

That is, for example, there are provided in the size tale 10:

a measurement date and time column 11, a name column 12 of the wearer, a body type column 13 to fill out distinction of opposition or stoop and size thereof, a column 14 to fill out of the inclination angle of shoulder from the base point N on the front of the left and right shoulders, a column 15 to fill out the inclination angle of shoulder from the base point M on the rear of the left and right shoulders, a column 16 to fill out average angle obtained by multiplying a sum of the inclination angle from the base point N on the front of the left and right shoulders and the inclination angle from the base point M on the rear of the left and right shoulders by ½, a column 17 to fill out value obtained by multiplying the length L of (F~D) to specify the base point N on the front of the left and right shoulders by (0.56±0.05), a size column 18 of M point to fill out number L1 obtained by multiplying ½ of the chest circumference length P by (0.177±0.005) to specify the base point M on the rear of the left and right shoulders and value L2 obtained by multiplying L1 by ¼, a height size column 19 to fill out a length to the point C positioned downward obtained by multiplying ½P of the chest circumference length from the back base point O' by 0.45, a chest circumference size column 20 to fill out value obtained by adding margin dimension as clearance to the real chest circumference P', a chest width column 21 to fill out a size of the bust width portion b3 in the bust line B actually measured, a side width column 22 to fill out a size of the side width portion b2 in the bust line B, a back width column 23 to fill out a size of the back width b1 in the bust line B, a waist size column 24 to fill out a size in the waist line W, a waist front width column 25 to fill out a width size of the front body FB in the waist line W, a waist rear width column 26 to fill out a width size of the rear body BB in the waist line W, a hip front width column 27 to fill out a size in the hip line H actually measured, a hip front width column 28 to fill out a width of the front body FB in the hip line H, and a hip rear width column 29 to fill out a width of the rear body BB in the hip line H.

(6) Another Embodiment of Specification Method of Correct Base Points N, M on the Front and Rear of the Left Shoulder As mentioned, although it is described the procedures to determine the position of the base points N, M on the front and rear of the left shoulder based on values actually measured, it will be conceivable another embodiment which is simplified.

That is, as described above, since the provisional position of the provisional base point M' on the rear of the left shoulder is specified on the pattern paper U by actual measurement of the chest circumference, it is computationally specified the length rcm of the neck line WN connecting the back base point O' and the provisional base point M' on the rear of the left shoulder. After the length rcm of the neck line WN is objectively determined, continuously the base point setting measure 30 is suspended from the neck and the position of the length rcm of the neck line WN on the left side from the standard point KP is obtained, thereby this position naturally becomes the correct position of the base point M (N) on the rear of the left shoulder in the body of the wearer having exemplary standard body type without opposition, stoop and the like.

To reflect this correct position of the base point M on the rear of the left shoulder on the pattern paper U, the length of the back side and the chest face side from the ground surface (GL) is measured by the height measuring measure 40, further α and β are calculated.

Next, as shown in FIG. 1, on the pattern paper U, the intersection of a trajectory t1 of scale length of the curved neck line WN from the bac base point O' and a trajectory t2 of scale length from the ground surface (GL) to the base point M on the rear of the left shoulder actually measured is set to the correct position of the base point M on the rear of the left shoulder on the pattern paper U.

Since the position of the back base point O' of the wearer can be objectively determined by this simplified procedures, the provisional base point on the rear of the left shoulder is determined through the position calculation method of the provisional base point M' (see above) based on the inventor's tailoring record for many years. Further, taking into consideration the correct positional information of the provisional base point M' on the rear of the left shoulder on the inherent body of the wearer to values of α, β measured by the base point setting measure 30, thereby the computational position of the provisional base point M' on the rear of the left shoulder calculated from the chest circumference is corrected, thus correct base point M on the rear of the left shoulder is specified on the pattern paper U.

(7) Formation of Correct Pattern Paper U

As mentioned, although the positional determination procedures of the correct base points N, M on the front and rear of the left shoulder concerning the front body FB and rear body BB of the left half body are described, similarly to the above, the correct positional determination of the base points N, M of the front and rear of the right shoulder concerning the front body FB and rear body BB of the right half body can be conducted.

In this way, the positions of the base points N, M on the front and rear of the left and right shoulders are calculated based on the objective position of the back base point O' and it can be produced on the basis of the above position the pattern paper U best fitting for the wearer and capable of easily moving (step S10).

Wholly considering for the suit, since the correct base points N, M on the front and rear of the left shoulder and the base point N, M on the front and rear of the right shoulder are determined to the optimal positions coinciding with the various body types such as opposition, stoop, shark's shoulders and slope shoulders, it can be kept balance of "balancing toy (swing operation)" in which portions of the left and right shoulders are balanced in right and left around the back base point O'. It can be provided a smart and reasonable suit in appearance and activity of the wearer.

That is, "balancing toy" is constituted so as to keep balance through weights of the left and right around a set center point and keeps balance so as not to tilt and topple over toward any of the left and right while swinging in the left and right direction as the center point becomes a balance point.

In the suit, when the inclination angle θ, θ' of shoulders from the base points N, M on the front and rear of the left and right shoulders, the length α of the back side to the base points N, M on the front and rear of the left and right shoulders from the ground surface (GL) and the length β of the chest side to the base points N, M on the front and rear of the left and right shoulders from the ground surface (GL) respectively coincides with the body type of the suit wearer, left and right balance function as same as the "balancing toy" around the back base point O' will occur. Further, such suit becomes a suit best fitting for the wearer in appearance and comfort (step S11, S12).

Further, based on that the base points N, M on the front and rear of the left and right shoulders are set by above dimensioning and various size adjustments are conducted on the basis of the base points N, M on the front and rear of the left and right shoulders, the pattern paper suitable for various body types can be produced, therefore the suit with good comfort can be produced. However, although it can be produced the pattern paper of the body type suitable for stoop, opposition and the like, there will exist a portion not suitable for the wearer having a predetermined special body type.

That is, in a case that there exist large and small of width or protuberance in back portion or chest portion of the wearer, in other words, in case of a person with large chest or small chest, it has to pay attention that the width of the front body FB and the rear body BB are naturally different from those of the wearer having the standard size.

Thus, the positions of the base points N, M on the front and rear of the left and right shoulders are finely adjusted corresponding to the body type of chest width or back width of the wearer. In a case that the base points N, M on the front and rear of the left and right shoulders are translated even if the front body FB and the rear body BB are under a condition that both lengths are mutually same, vertical motion will occur in the front body FB and the rear body BB.

Figure 19:
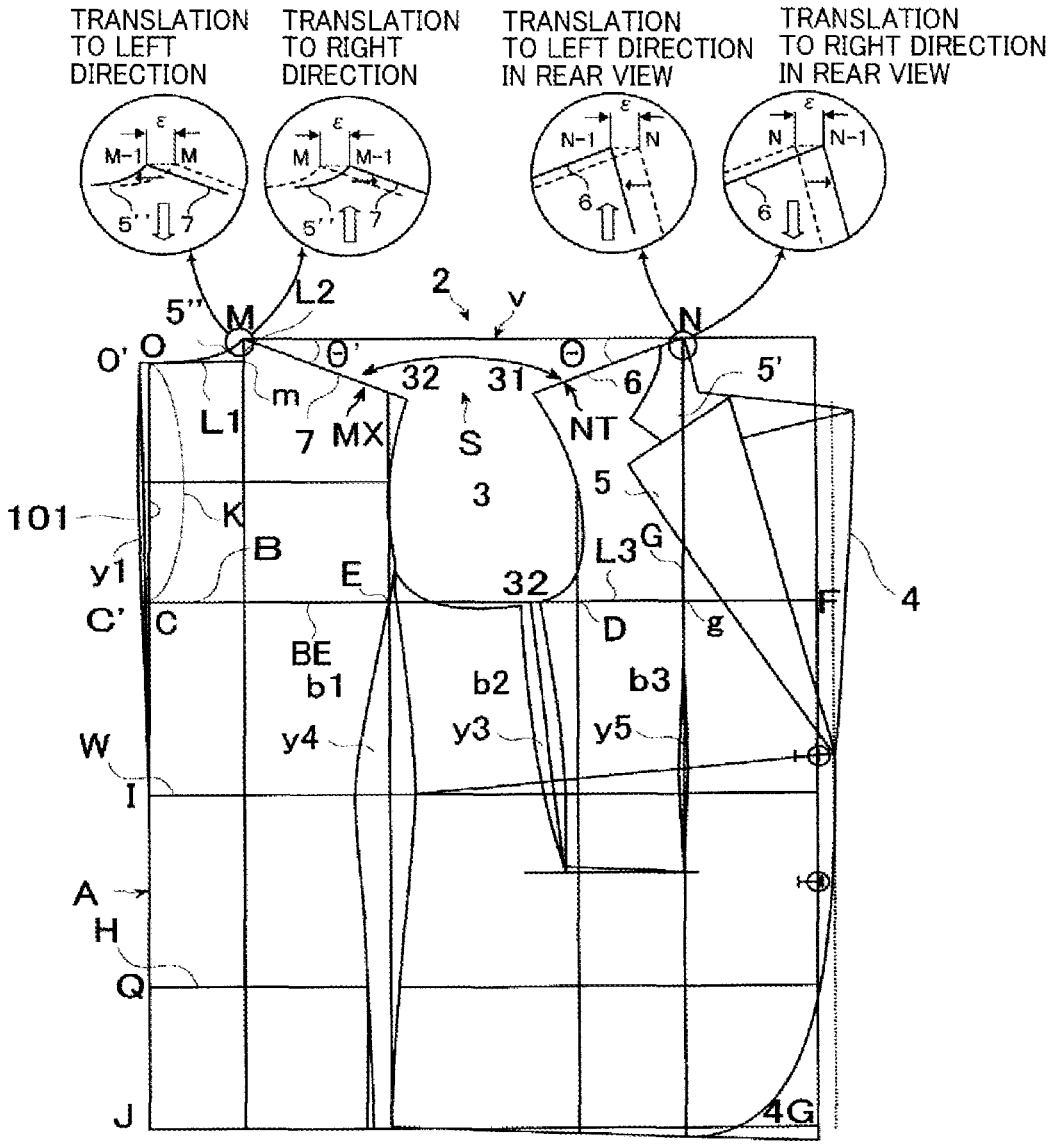
FIG. 19 is an explanatory view for fine-adjusting positions of the base points N, M on the front and the rear of the left shoulder according to the body type of chest width or dorsal width of the wearer.

That is, in a size figure of the pattern paper shown in FIG. 19, the base points N, M on the front and rear of the left and right shoulders are translated by a length ε (for example, 5 mm) and fine adjustment is done, thereby various sizes are collected in a state that new base points N−1, M−1 on the front and rear of the left and right shoulders are set to the standard points, as a result, the pattern paper is produced.

For example, in a case that the base point N on the front of the left and right shoulders is, as shown in FIG. 19, moved in the left direction by 5 mm and new base point N−1 on the front of the left and right shoulders is set to the base point, the area of the front body FB becomes wide due to such movement and upper movement occurs in the front body FB.

In a case that the base point M on the rear of the left and right shoulders is, as shown in FIG. 19, moved in the right direction by 5 mm and new base point M−1 on the rear of the left and right shoulders is set to the base point, the area of the rear body BB becomes wide due to such movement and upper movement occurs in the front body FB.

Further, in a case that the base point N on the front of the left and right shoulders is, as shown in FIG. 19, moved in the right direction by 5 mm and new base point N−1 on the front of the left and right shoulders is set to the base point, the area of the front body FB becomes narrow due to such movement and lower movement occurs in the front body FB.

In a case that the base point M on the rear of the left and right shoulders is, as shown in FIG. 19, moved in the left direction by 5 mm and new base point M−1 on the rear of the left and right shoulders is set to the base point, the area of the rear body BB becomes narrow due to such movement and lower movement occurs in the rear body BB.

In this way, the base points N, M on the front and rear of the left and right shoulders are moved by the length of ε and finely adjusted and new base points N−1, M−1 on the front and rear of the left and right shoulders are set to the base points, thereby adjustment of the chest width, the back width is conducted. Therefore, movement in the upper and lower direction occurs, the back base point O' important for "swinging toy" (swing operation) can be determined and further the suit fitting the body type and having good comfort can be provided.

Here, this "swinging toy" (swing operation) occurs not only in the left and right direction of the shoulders but also in the front and rear direction of the shoulders. Since the suit pattern is formed in a state of swing operation around the back base point O' both in the left and right horizontal direction and in the front and rear direction centering on the shoulder, the suit fitting to the body type of the wearer and having good comfort can be produced.

REFERENCE SIGNS LIST

100 outer wear body
101 center line on back
101' inherent centerline on back
1 left half body part
2 right half body part
3 sleeve hole portion
35 front end portion of cutout
36 rear end portion of cutout
4 front edge portion of front body
5 collar portion
6 front shoulder ridge line
7 rear shoulder ridge line
10 size table
U pattern paper
b1 back width portion
b2 side width portion
b3 chest width portion
N', N' provisional base point on front of left and right shoulders
M', M' provisional base point on rear of left and right shoulders
N, N base point on front of left and right shoulders
M, M base point on rear of left and right shoulders
P ½ of length of chest circumference
O back upper end
O' back base point
A suit pattern
m movement point
g vertical point
r curved length
GL ground surface
θ front inclination angle
θ' rear inclination angle
v absolute horizontal line
S cutout
30 base point setting measure
31 cord in loop
32 weight
KP standard point
33 display scale
GP back base point
40 height measuring measure
41 long cord
42 weight for height
43 display scale
WN neck line
α length from ground surface GL to base point M on rear of left and right shoulders
β length from ground surface GL to base point N on front of left and right shoulders

The invention claimed is:

1. A suit pattern comprising:

a left half body part and a right half body part formed by dividing a suit body into a left part and a right part along a back center line of a back portion;

left and right sleeve hole portions with an approximate ellipse shape formed in center upper portions of the left and right half body parts by partially cutting out;

a collar portion formed at a front edge portion of the left half body part;

a chest width portion in front of the sleeve hole portion;

a side width portion under the sleeve hole portion; and a back width portion behind the sleeve hole portion;

wherein the suit pattern is formed by joining and sewing respectively partial cutout portions of the left and right sleeve hole portions and back sewing lines of the left and right half body parts, wherein a point is moved forward from back base point to be an upper end of a back center line inherent for a wearer by a length calculated by adopting a correction formula ruled beforehand for a length of chest circumference or a length around neck, wherein a point vertically moved upward by a length of approximate ¼ of a movement length from the moved point and specified is set to a provisional base point on a rear of a left and a right shoulders, wherein a point specified by an intersection of a vertical line at a position of approximate 0.5 to 0.6 times of a length to a front edge of the sleeve hole portion from a front edge of a front body and an absolute horizontal line from the provisional base point on the rear of the left and the right shoulders is set to a provisional base point on a front of the left and the right shoulders, wherein it is obtained a difference between a length of a curved neck line from the back base point of the back in a rear body to the provisional base point on the rear of the left and the right shoulders and a length from the back base point to a provisional standard point specified in a middle of the neck line, wherein a length from the standard point specified in the middle of the neck line by using a value of the difference to a ground surface passing through a back side of a body of the wearer and a length to the ground surface passing through a chest side are respectively corrected and a correct position of the base point on the rear of the left and right shoulders is specified, wherein a line connecting from a corrected right base point on the front of the left and right shoulders or the standard point in the middle of the neck line to a front edge of the cutout of the sleeve hole with a predetermined adjustment angle is set to a ridge line on the front of the left and right shoulders, wherein a line connecting from the corrected right base point on the rear of the left and the right shoulders or the standard point in the middle of the neck line to a front edge of the cutout of the sleeve hole with a respective shoulder inclination angle is set to a ridge line on the rear of the left and the right shoulders, and wherein the ridge line on the front of the left and the right shoulders and the ridge line on the rear of the left and right shoulders are joined and sewn.

2. The suit pattern according to claim 1, wherein, when the base point on the rear of the left and the right shoulders is specified, the correction formula adopted for the length of the chest circumference from the back center line is (an approximate ½ of the length of the chest circumference)×(a number in a range of 0.15 to 0.20).

3. The suit pattern according to claim 1, wherein, when the length around neck is specified, the correction formula adopted for the length around neck from the back center line is ((the length around neck (mm))+(a number in a range of 10 to 15))/(a number in a range of 5 to 7).

4. A measuring device for suit pattern comprising:

a curved frame mountable along a backside of neck of a wearer;

left and right inclination plates supported through a support shaft at a left end portion and a right end portion of the curved frame; and a ground height measuring device capable of measuring a length from base points on the front and the rear of the left and the right shoulders set on a free end portion of the curved frame to a ground surface;

wherein the curved frame has a left curved portion and a right curved portion which are independently formed and has an expansion and contraction mechanism in which one of base ends in the left curved portion and the right curved portion is made pluggable into the other of the base ends in the left curved portion and the right curved portion, wherein the ground height measuring device has an upper half portion measuring measure suspended downward on the back side or the chest side from the base point on the front and the rear of the left and the right shoulders, and has a weight having reflection function which irradiates infrared ray on the ground surface and receives reflection from the ground surface, the weight being formed at lower end of the upper half portion measuring measure.

* * * * *